United States Patent [19]

Deguchi et al.

[11] Patent Number: 4,740,454

[45] Date of Patent: Apr. 26, 1988

[54] SILVER HALIDE PHOTOGRAPHIC MATERIAL

[75] Inventors: Naoyasu Deguchi; Tetsuro Kojima; Hideo Miyazaki; Shigeru Ohno; Koki Nakamura, all of Kanagawa, Japan

[73] Assignee: Fuji Photo Film Co., Ltd., Kanagawa, Japan

[21] Appl. No.: 886,490

[22] Filed: Jul. 17, 1986

[30] Foreign Application Priority Data

Jul. 17, 1985 [JP] Japan ..... 60-157863

[51] Int. Cl.[4] ..... G03C 1/34; G03C 1/02

[52] U.S. Cl. ..... 430/567; 430/600; 430/611; 430/505

[58] Field of Search ..... 430/567, 600, 611, 505, 430/504, 362

[56] References Cited

U.S. PATENT DOCUMENTS 4,433,048 2/1984 Solberg et al. ..... 430/567

4,554,245 11/1985 Hayashi et al. ..... 430/600

*Primary Examiner*—Paul R. Michl

*Assistant Examiner*—Mark R. Buscher

*Attorney, Agent, or Firm*—Sughrue, Mion, Zinn, Macpeak, and Seas

[57] ABSTRACT

A silver halide photographic material comprising a support having thereon at least one light-sensitive silver halide emulsion layer containing tabular silver halide grains which have a diameter not less than 5 times the thickness thereof and account for at least 50% of the total projected area of the silver halide grains present in the silver halide emulsion layer and the silver halide photographic material also contains at least one compound represented by following general formulae (I), (II), (III) and (IV):

(I)

(II)

(III)

(IV)

wherein R represents a straight chain, branched chain or cyclic alkylene group, a straight chain or branched chain alkenylene group, a straight chain or branched chain aralkylene group or an arylene group; $R_1$ represents a substituted or unsubstituted alkyl group, a substituted or unsubstituted alkenyl group, a substituted or unsubstituted aralkyl group or a substituted or unsubstituted aryl group; Z represents a hydrogen atom or a polar substituent; X represents a hydrogen atom, a cation necessary for neutralizing the molecule or a precursor; and n represents 0 or 1.

The silver halide photographic material has improved image sharpness not only at high spatial frequencies but also at low spatial frequencies.

21 Claims, No Drawings

SILVER HALIDE PHOTOGRAPHIC MATERIAL

FIELD OF THE INVENTION

The present invention relates to a silver halide photographic material having improved sharpness over a wide range from the high frequency area to the low frequency area.

BACKGROUND OF THE INVENTION

Generally, the time sharpness of a photographic light-sensitive material is reduced as one increases the thickness of any emulsion layer(s) therein because of light scattering by the silver halide emulsion grains. Particularly, in a multilayer color photographic light-sensitive material having a red-sensitive emulsion layer, a green-sensitive emulsion layer, and a blue-sensitive layer, light scattering is increased in a cumulative fashion because of the multilayer structure thereof, and a reduction in sharpness becomes particularly high in the lower emulsion layer(s).

In U.S. Pat. No. 3,402,046, a method for improving sharpness where coarse grains having a particle size of 0.7 micron or more which cause less light scattering are used in the blue-sensitive emulsion layer of the uppermost emulsion layer in a multilayer color photographic light-sensitive material is described.

Further, in U.S. Pat. No. 3,658,536, a method for improving sharpness where one of two blue-sensitive emulsion layers is positioned below a green-sensitive emulsion layer or a red-sensitive emulsion layer is described.

However, these methods have the disadvantages that the graininess of the blue-sensitive emulsion layer is deteriorated because of using coarse grains having a larger particle size than required as the blue-sensitive emulsion grains.

In U.S. Pat. No. 4,439,520, a color photographic light-sensitive material having improved sharpness, sensitivity and graininess, where tabular silver halide grains having a thickness of less than 0.3 micron, a diameter of at least 0.6 micron and a diameter/thickness ratio of 8:1 or more are employed in at least one of the green-sensitive emulsion layer and the red-sensitive emulsion layer is described.

However, in the case of employing such tabular silver halide grains, although sharpness in the high frequency area is improved, sharpness at a low frequency area conversely tends to deteriorate. The term "low frequency area" as used herein means an area having a frequency of less than 10 cycles/mm and the term "high frequency area" as used herein means an area having a frequency of not less than 10 cycles/mm.

With tabular silver halide grains, high reflection on the surface of grains is pronounced while they have less scattering of light passing therethrough. Due to their strong light reflection, multiple reflection occurs between a tabular grain silver halide emulsion layer and the surface of a film or between a non-tabular silver halide emulsion layer and a tabular grain silver halide emulsion layer when the non-tabular silver halide emulsion layer is present between the tabular grain silver halide emulsion layer and the surface of a film. Further, in the tabular grain silver halide emulsion layer itself, multiple reflection occurs between tabular silver halide grains since the tabular silver halide grains are generally distributed substantially in two or more layers.

Such light reflections have a tendency to deteriorate sharpness at the low frequency area rather than at the high frequency area.

The ratio of reflected light to transmission light not absorbed varies depending on the thickness of the tabular silver halide grains. The variation of reflectance against wavelength depending on the thickness of a silver bromide sheet in the area including is described in *Research Disclosure*, No. 25330 (May 1985).

It is difficult to reduce the reflection from the surface of tabular silver halide grains having a thickness of 0.07 μm to 0.16 μm over all wavelength regions of visible light.

For instance, when tabular silver halide grains which reflect blue light, but do not substantially reflect minus blue light, are employed for the purpose of improving the sharpness of lower layers in a blue-sensitive silver halide emulsion layer of a multilayer color photographic light-sensitive material which has a red-sensitive silver halide emulsion layer, a green-sensitive silver halide emulsion layer and the blue-sensitive silver halide emulsion layer in this order from a support, although the sharpness of lower layer(s) is/are certainly improved, the reflection of blue light at the blue-sensitive silver halide emulsion layer is strong and, thus, multiple reflection between the blue-sensitive layer and the surface of a film occurs, resulting in degradation of sharpness at the low frequency area in the blue-sensitive layer. An attempt at controlling the thickness of tabular silver halide grains in order to avoid such reflection of blue light leads to increase in the relfection of green light or red light, and results in deterioration of the sharpness in the low frequency area of magenta images or cyan images.

On the other hand, when tabular silver halide grains having a very thin thickness as used to minimize the reflection of visible light due to the tabular silver halide grains in the blue-sensitive emulsion layer, the absorption of blue light decreases as described above and blue sensitivity becomes insufficient. In order to compensate for such a decrease in blue sensitivity, it is necessary to employ blue-sensitive tabular silver halide grains having a large size. However, this can bring about an adverse affect such as an increase in graininess.

As described above, although sharpness in the high frequency area is improved by employing tabular silver halide grains in a light-sensitive silver halide emulsion layer, sharpness in the low frequency area conversely tends to deteriorate.

Moreover, in the case of using a tabular grain silver halide emulsion, there is the tendency that an edge effect is obtained to a lesser extent as compared with the use of a spherical grain silver halide emulsion. It is believed that this is because development inhibition from highly exposed areas to low exposure area is lessened due to the high developing speed of tabular grain silver halide emulsions at the initial stage of development.

Since the edge effect is hardly obtained with tabular silver halide grains, sharpness in the low frequency area is inferior in comparison with spherical silver halide grains.

According to the investigations by the inventors, it has been found that image sharpness in the low frequency area can be improved by increasing in the interimage effect between light-sensitive silver halide emulsion layers. Some technique for increasing the interimage effect are known. For example, it is described in U.S. Pat. No. 3,536,486 that a preferred interimage effect is obtained by introducing a diffusible 4-thiazolin-2-thione into an exposed color reversal photographic element. Also, a method for obtaining a preferred interimage effect by introducing a diffusible 4-thiazolin-2-thione into an unexposed color reversal photographic element is described in U.S. Pat. No. 3,536,487. Further, in Japanese Patent Publication No. 34169/73, it is described that a remarkably high interimage effect is achieved by the presence of an N-substituted 4-thiazolin-2-thione compound when silver halide is reduced to silver upon development of a color photographic light-sensitive material.

However, with these methods described above, the interimage effect obtained and the improvement in sharpness in the low frequency area are extremely small and are insufficient.

Image sharpness is visually very important not only in the high frequency area but also in the low frequency area. Thus, it has been desired to improve sharpness in both the high frequency are and in the low frequency area.

SUMMARY OF THE INVENTION

Therefore, an object of the present invention is to provide a silver halide photographic material having improved sharpness over a wide range from the low frequency area to the high frequency area without any accompanying degradation in other photographic properties.

Another object of the present invention is to provide a multilayer color photographic light-sensitive material having improved sharpness and a high interimage effect.

A further object of the present invention is to provide a black-and-white silver halide photographic material having improved sharpness and graininess.

Other objects of the present invention will become apparent from the following detailed description and Examples.

These objects of the present invention have been reached by providing a silver halide photographic material comprising a support having thereon at least one light-sensitive silver halide emulsion layer containing tabular silver halide grains which have a diameter not less than 5 times the thickness thereof and which account for at least 50% of the total projected area of the silver halide grains present in the silver halide emulsion layer, the silver halide photographic material further containing at least one compound represented by the following general formulae (I), (II), (III) and (IV):

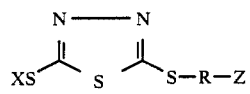
(I)

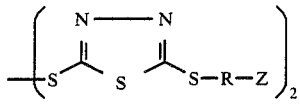
(II)

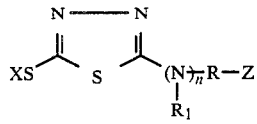
(III)

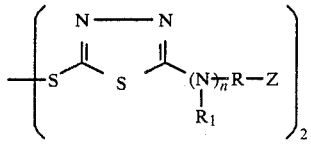
(IV)

wherein R represents a straight chain, branched chain or cyclic alkylene group, a straight chain or branched chain alkenylene group, a straight chain or branched chain aralkylene group or an arylene group; $R_1$ represents a substituted or unsubstituted alkyl group, a substituted or unsubstituted alkenyl group, a substituted or unsubstituted aralkyl group or a substituted or unsubstituted aryl group; Z represents a hydrogen atom or a polar substituent; X represents a hydrogen atom, a cation necessary for neutralizing the molecule or a precursor; and n represents 0 or 1.

DETAILED DESCRIPTION OF THE INVENTION

The compounds represented by general formulae (I), (II), (III) and (IV) are described in more detail below.

In the above described general formulae, R preferably represents a straight, branched or cyclic alkylene group having 1 to 12 carbon atoms, preferably 1 to 6 carbon atoms (e.g., a methylene group, an ethylene group, a propylene group, a butylene group, a hexylene group, a 1-methylethylene group, and a 1,4-cyclohexylene group), a straight or branched alkenylene group having 2 to 12 carbon atoms, preferably having 2 to 6 carbon atoms (e.g., a vinylene group, and a 1-methylvinylene group), a straight or branched aralkylene group having 7 to 20 carbon atoms, preferably 7 to 15 carbon atoms (e.g., a benzylidene group), or an arylene group having 6 to 20 carbon atoms, preferably 6 to 15 carbon atoms (e.g., a phenylene group and a naphthylene group).

$R^1$ represents a hydrogen atom, a substituted or unsubstituted alkyl group having 1 to 12 carbon atoms, preferably 1 to 6 carbon atoms (e.g., a methyl group, an ethyl group, a propyl group and a 2-dimethylaminoethyl group), a substituted or unsubstituted aryl group having 6 to 12 carbon atoms, preferably 6 to 12 carbon atoms (e.g., a phenyl group and a 2-methylphenyl group), a substituted or unsubstituted alkenyl group having 2 to 12 carbon atoms, preferably 2 to 6 carbon atoms (e.g., a propenyl group and a 1-methylvinyl group), or a substituted or unsubstituted aralkyl group having 7 to 20 carbon atoms, preferably 7 to 15 carbon atoms (e.g., a benzyl group and a phenethyl group).

Z represents a substituted or unsubstituted amino group having 1 to 12 carbon atoms, preferably 1 to 6 carbon atoms (including salts; e.g., an amino group, an amino hydrochloride group, a methylamino group, a dimethylamino group, a dimethylamino hydrochloride group, a dibutylamino group, a dipropylamino group, and an N-dimethylaminoethyl-N-methylamino group), a quaternary ammoniumyl group having 3 to 18 carbon atoms, preferably 3 to 12 carbon atoms (e.g., a trimethylammoniumyl chloride group and a dimethylbenzylammoniumyl chloride group), an alkoxy group having 1 to 12 carbon atoms, preferably 1 to 6 carbon atoms (e.g., a methoxy group, an ethoxy group and a 2-hydroxyethoxy group), an aryloxy group having 6 to 20 carbon atoms, preferably 6 to 15 carbon atoms (e.g., a phenoxy group), an alkylthio group having 1 to 12 carbon atoms, preferably 1 to 6 carbon atoms (e.g., a methylthio group and a butylthio group), an arylthio group having 6 to 20 carbon atoms, preferably 6 to 15 carbon atoms (e.g., a phenylthio group), a 5- to 7-membered heterocyclic oxy group containing 1 to 12 carbon atoms, preferably 1 to 6 carbon atoms, and one or more of N, O and S as hetero atom(s) (e.g., a 2-pyridyloxy group and a 2-imidazolyloxy group), a 5- to 7-membered heterocyclic thio group containing 1 to 12 carbon atoms, preferably 1 to 6 carbon atoms, and one or more of N, O and S as hetero atom(s) (e.g., a 2-benzothiazolylthio group and a 4-pyrazolylthio group), a sulfonyl group having 1 to 12 carbon atoms, preferably 1 to 6 carbon atoms (e.g., a methanesulfonyl group, an ethanesulfonyl group and a p-toluenesulfonyl group), a carbamoyl group having 1 to 12 carbon atoms, preferably 1 to 6 carbon atoms (e.g., an unsubstituted carbamoyl group and a methylcarbamoyl group), a sulfamoyl group having 0 to 12 carbon atoms, preferably 0 to 6 carbon atoms (e.g., an unsubstituted sulfamoyl group and a methylsulfamoyl group), a carbonamido group having 1 to 12 carbon atoms, preferably 1 to 6 carbon atoms (e.g., an acetamido group and a benzamido group), a sulfonamido group having 1 to 12 carbon atoms, preferably 1 to 6 carbon atoms (e.g., a methanesulfonamido group and a benzenesulfonamido group), an acyloxy group having 1 to 12 carbon atoms, preferably 1 to 6 carbon atoms (e.g., an acetyloxy group and a benzoyloxy group), a ureido group having 1 to 12 carbon atoms, preferably 1 to 6 carbon atoms (e.g., an unsubstituted ureido group, a methylureido group and an ethylureido group), an acyl group having 1 to 12 carbon atoms, preferably 1 to 6 carbon atoms (e.g., an acetyl group and a benzoyl group), an aryloxycarbonyl group having 7 to 20 carbon atoms, preferably 7 to 15 carbon atoms (e.g., a phenoxycarbonyl group), a thioureido group having 1 to 12 carbon atoms, preferably 1 to 6 carbon atoms (e.g., an unsubstituted thioureido group and a methylthioureido group), a sulfonyloxy group having 1 to 12 carbon atoms, preferably 1 to 6 carbon atoms (e.g., a methanesulfonyloxy group and a p-toluenesulfonyloxy group), a 5- to 7-membered heterocyclic group containing 1 to 12 carbon atoms, preferably 1 to 6 carbon atoms, and one or more of N, O and S as hetero atom(s) (e.g., a 1-morpholino group, a 1-piperidino group, a 2-pyridyl group, a 4-pyridyl group, a 2-thienyl group, a 1-pyrazolyl group, a 2-imidazolyl group, a 2-tetrahydrofuryl group and a 2-tetrahydrothienyl group), a cyano group, a nitro group, a sulfonic acid group or a salt thereof such as sodium or potassium salt, a halogen atom, a hydroxyl group, a carboxylic acid group or a salt thereof such as sodium or potassium salt, and an alkoxycarbonyl group having 2 to 12 carbon atoms, preferably 2 to 6 carbon atoms (e.g., a methoxycarbonyl group and an ethoxycarbonyl group).

X represents a hydrogen atom, a cation necessary for neutralizing the molecule (for example, a sodium ion, a potassium ion, a zinc ion, a nickel ion, a magnesium ion, a calcium ion, an ammonium ion, etc.) or a precursor which is a group capable of being converted X to a hydrogen atom or an alkali metal ion under alkaline conditions (for example, an acetyl group, a cyanoethyl group, a methanesulfonylethyl group, etc.).

Of the compounds represented by general formulae (I), (II), (III) and (IV), those represented by general formulae (I) and (III) are preferred. The compounds represented by general formula (I) or (III) where R represents a straight chain or branched chain alkylene group are more preferred. Further preferred compounds are those represented by general formulae (I) and (III) where Z represents a substituted or unsubstituted amino group or a salt thereof.

In accordance with extensive investigations by the inventors, it has been found that compounds represented by general formulae (I), (II), (III) and (IV) interact with iodine ions which are released upon development of a silver halide emulsion containing silver iodide and significantly inhibit development of the silver halide emulsion.

This phenomenon will now be explained using an edge part of an image having a high exposure area and a low exposure area. In the high exposure area the amount of developed silver is large and the amount of iodine ions released is also large. On the contrary, the amount of developed silver is small and the amount of iodine released is also small in the low exposure area. Therefore, iodine ions diffuse from the high exposure area to the low exposure area of the edge part. The iodine ions interact with the compounds represented by general formulae (I), (II), (III) and (IV) and effectively inhibit development at the high exposure area and the low exposure area of the edge part whereby the edge is rendered more clear, resulting in an improvement in sharpness. This effect is remarkably observed the low frequency area.

As described above, in the case of employing tabular silver halide grains, the sharpness in the low frequency area tends to deteriorate, while sharpness in the high frequency area is improved. However, when the compounds represented by general formulae (I), (II), (III) and (IV) are used together with tabular silver halide grains, sharpness can be improved over a wide range from the low frequency area to the high frequency area and, thus, sharpness is visually extremely increased.

Specific examples of compounds represented by general formulae (I), (II), (III) or (IV) are set forth below, but the present invention should not be construed as being limited thereto.
(1)
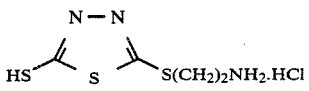
(2)
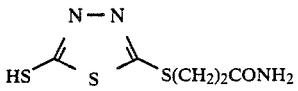
(3)
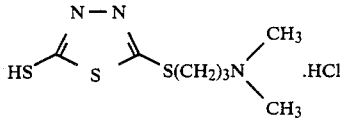
(4)
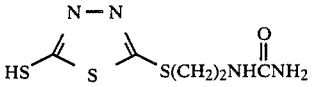
(5)
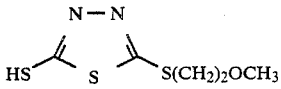
(6)
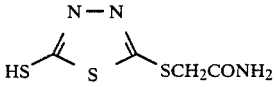
(7)
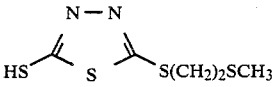
(8)
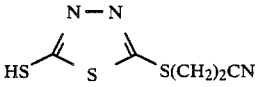
(9)
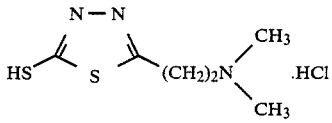
(10)
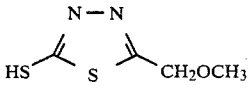
(11)
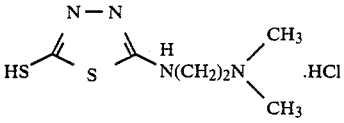
(12)
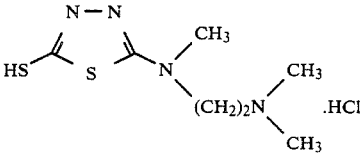
-continued
(13)
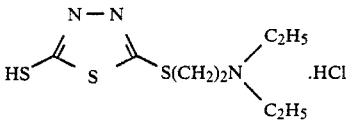
(14)
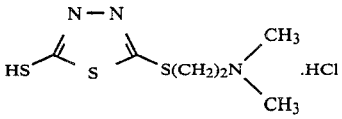
(15)
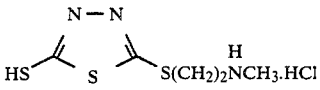
(16)
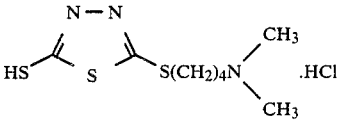
(17)
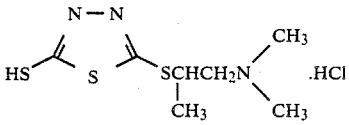
(18)
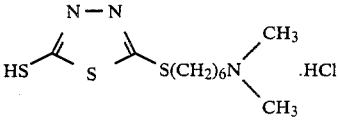
(19)
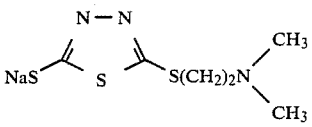
(20)
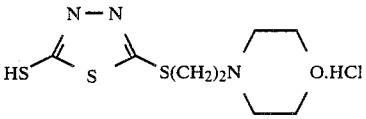
(21)
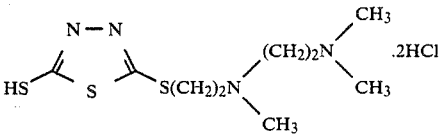
(22)
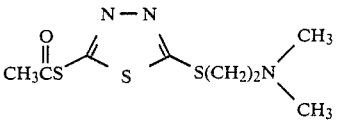
(23)
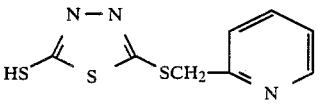
(24)
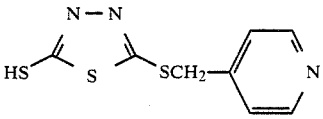

-continued
(25)
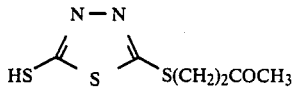
(26)
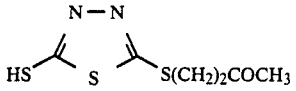
(27)
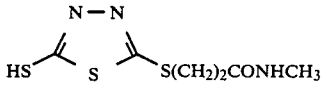
(28)
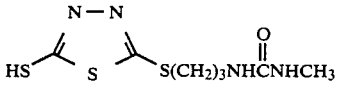
(29)
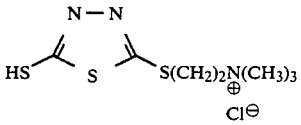
(30)
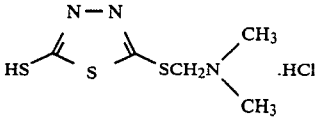
(31)
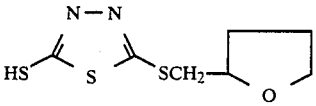
(32)
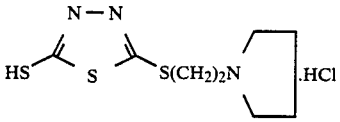
(33)
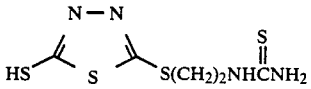
(34)
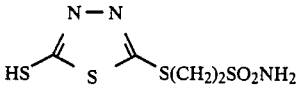
(35)
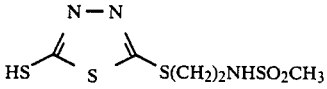
(36)
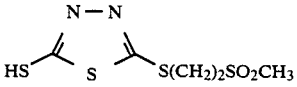
(37)
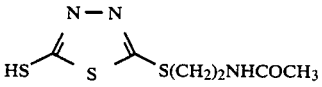
(38)
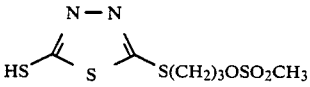
-continued
(39)
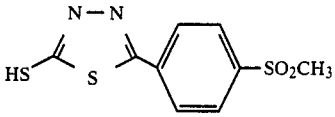
(40)
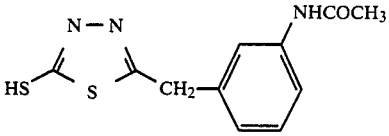
(41)
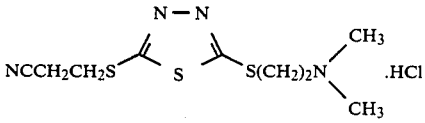
(42)
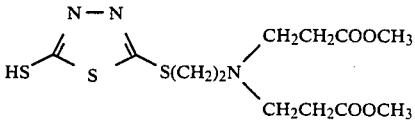
(43)
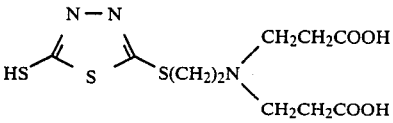
(44)
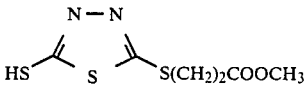
(45)
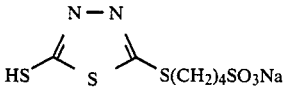
(46)
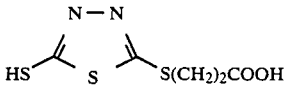
(47)
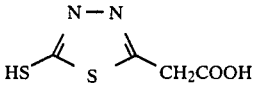
(48)
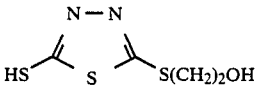
(49)
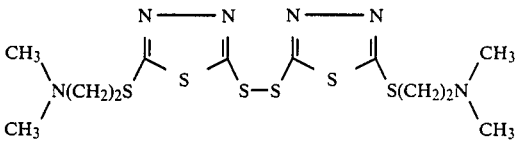
(50)
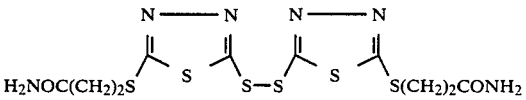
(51)
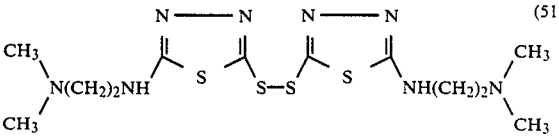

-continued (52)

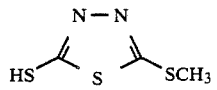

(53)

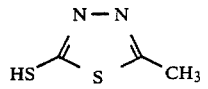

(54)

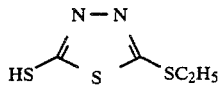

The compounds of general formulae (I), (II), (III) and (IV) which are used in the present invention can be synthesized following the procedure in *Advances in Heterocyclic Chemistry,* Vol. 9, pp. 165–209, Academic Press, New York (1968).

Typical preparation examples are shown below.

PREPARATION EXAMPLE 1

Preparation of Compound (1)

7.5 g of 2,5-dimercapto-1,3,4-thiadiazole, 5.8 g of 2-aminoethylchloride hydrochloride and 4 g of pyridine were added to 60 ml of n-butanol, and the resulting mixture was refluxed for 2 hours. The reaction mixture was cooled with ice. Crystals precipitated which were filtered off and recrystallized from a methanol/water (1:1 by volume) mixture. Yield: 7.1 g; m.p.=228°–229° C. (decomposed).

PREPARATION EXAMPLE 2

Preparation of Compound (14)

7.5 g of 2,5-dimercapto-1,3,4-thiadiazole, 7.3 g of 2-dimethylaminoethyl chloride hydrochloride and 4 g of pyridine were added to 60 ml of n-butanol, and the resulting mixture was heated under reflux for 2 hours. The reaction mixture was cooled with ice. Crystals precipitated which were collected by filtration and recrystallized from an ethanol. Yield: 7.9 g; m.p.=161°–163° C.

PREPARATION EXAMPLE 3

Preparation of Compound (13)

7.5 g of 2,5-dimercapto-1,3,4-thiadiazole, 8.6 g of 2-diethylaminoethyl chloride hydrochloride and 4 g of pyridine were added to 60 ml of n-butanol, and the resulting mixture was heated under reflux for 2 hours. The reaction mixture was cooled with ice. Crystals precipitated which were collected by filtration and recrystallized from an ethanol/water (1:1 by volume) mixture. Yield: 10.1 g; m.p.=184°–186° C.

PREPARATION EXAMPLE 4

Preparation of Compound (3)

7.5 g of 2,5-dimercapto-1,3,4-thiadiazole, 7.9 g of 3-dimethylaminopropyl chloride hydrochloride and 4 g of pyridine were added to 60 ml of n-butanol, and the resulting mixture was heated under reflux for 2 hours. The reaction mixture was cooled with ice. Crystals precipitated which were collected by filtration and recrystallized from ethanol. Yield: 11 g; m.p.=149°–152° C.

PREPARATION EXAMPLE 5

Preparation of Compounds (42) and (43)

(1) Preparation of 2-N,N-bis(2-methoxycarbonylethyl)amino]ethyl chloride hydrochloride 6.1 g of 2-aminoethanol was added to 75 ml of methanol, and 20 ml of methyl acrylate was dropwise added thereto while cooling with ice. After the dropwise addition, the resulting mixture was stirred for 2 hours while cooling with ice and then further stirred for 20 hours at room temperature. The reaction mixture was distilled under reduced pressure. To the oil thus obtained (23 g) was added 100 ml of chloroform, and 8.7 ml of thionyl chloride was dropwise added thereto while cooling with ice. Then the resulting mixture was heated under reflux for 1 hour. The reaction mixture was then distilled under reduced pressure. The residue was recrystallized from an isopropanol/n-hexane (3:1 by volume) mixture. Yield: 21 g; m.p.=103°–104° C.

(2) Preparation of Compound (42)

7.5 g of 2,5-dimercaptothiadiazole, 14.4 g of 2-[N,N-bis(2-methoxycarbonylethyl)amino]ethyl chloride and 8.1 g of pyridine were added to 80 ml of dioxane, and the resulting mixture was heated under reflux for 2 hours. The reaction mixture was then distilled. The residue was purified by column chromatography (stationary phase: alumina; developing solvent: methanol/ethyl acetate (1:3 by volume)) to yield compound (42) in a syrup form. Yield: 8.4 g.

(3) Preparation of Compound (43)

7.3 g of the compound (42) was added to 20 ml of a 20 wt% aqueous sodium hydroxide solution and stirred at 50° C. for 2 hours. The reaction solution was neutralized with 35 wt% hydrochloric acid while cooling with ice. The precipitate was removed by filtration and recrystallized from a DMF/ethanol (1:9 by volume) mixture to obtain compound (43). Yield: 3.2 g; m.p.=188°–189° C.

When the compounds represented by general formulae (I), (II), (III) and (IV) or a mixture thereof according to the present invention are employed in a multilayer color photographic light-sensitive material, it can be incorporated into at least one layer selected from a light-sensitive silver halide emulsion layer containing tabular silver halide grains, a light-sensitive silver halide emulsion layer which does not contain tabular silver halide grains and a light-insensitive subsidiary layer such as a yellow filter layer, an antihalation layer, an intermediate layer or a protective layer, etc. It is most preferred to incorporate the compound(s) into a light-sensitive silver halide emulsion layer.

Further, in the case of applying the present invention to a black-and-white photographic light-sensitive material, the compounds represented by general formulae (I), (II), (III) and (IV) or a mixture thereof may be incorporated into a light-sensitive silver halide emulsion layer and/or a conventional protective layer.

The amount of the compound(s) represented by general formulae (I), (II), (III) and (IV) or a mixture thereof according to the present invention added to the photographic light-sensitive material varies depending upon the property or purpose of the photographic light-sensitive material or the method of development processing to be employed, etc. However, when it is employed in a light-sensitive silver halide emulsion layer, an amount of $10^{-1}$ mol to $10^{-6}$ mol per mol of silver halide is suitable, with $3\times10^{-2}$ mol to $3\times10^{-5}$ mol being more preferable. When it is added to a light-insensitive layer such as a yellow filter layer, an antihalation layer, an intermediate layer or a protective layer, an amount of $10^{-8}$ mol/m$^2$ to $10^{-2}$ mol/m$^2$, particularly $10^{-7}$ mol/m$^2$ to $10^{-3}$ mol/m$^2$ of the layer is preferred.

In order to incorporate the compound represented by general formulae (I), (II), (III) and (IV) or a mixture thereof into the photographic light-sensitive material, the compound(s) is/are dissolved in a solvent as is conventionally employed for the production of a photographic light-sensitive material, for example, water, methanol, ethanol, propanol or a fluorinated alcohol, etc., and then added to a hydrophilic colloid.

When incorporating such compound into a light-sensitive silver halide emulsion layer, it may be added at any stage, for example, during the formation of silver halide grains, during physical ripening, just before chemical ripening, during chemical ripening, after chemical ripening or at the preparation of a coating solution, etc., and the time of addition can be appropriately selected depending on convenience.

In the following, the tabular silver halide grains which can be used in the present invention are illustrated in more detail.

The tabular silver halide grains used in the present invention are those where the ratio of grain diameter/-thickness of 5 or more.

The term "diameter" of silver halide grains as used herein means the diameter of a circle which has an area equal to the projected area of the grain. In the present invention, the diameter of the tabular silver halide grains preferably is in a range of 0.4 to 5.0 μm, more preferably, 0.8 to 4.0 μm.

In general, a tabular silver halide grain is in the form of a plate having two parallel planes. Accordingly, the term "thickness" as used herein represents the distance between the two major parallel planes of the tabular silver halide grain. In the present invention, the thickness of the tabular silver halide grains preferably is in a range of from 0.03 μm to 0.40 μm, more preferably from 0.04 μm to 0.35 μm.

The halogen composition of the tabular silver halide grains may be any of silver bromide, silver iodide, silver iodobromide, silver chlorobromide, silver chloroiodobromide and silver chloride, but silver bromide and silver iodobromide are preferred. Silver bromide, and silver iodobromide having a silver iodide content of not more than 30 mol% is particularly preferred.

Typical methods for preparing such tabular silver halide grains are now described.

The preparation of the tabular silver halide grains can be carried out by processes known in the art.

For example, they can be obtained by a process which comprises forming seed crystals where tabular grains are present in an amount of 40% by weight or more in an environment having a comparatively low pBr (1.3 or less), and growing the seed crystals by simultaneously adding silver and halogen solutions while keeping the pBr in the above described range.

In growing the grains, it is preferred to add the silver and halogen solution in a manner so as to not form fresh crystal nuclei.

The size of the tabular silver halide grains can be adjusted by controlling the temperature, selecting the kind and the amount of solvent, controlling the addition rate of the silver salt and the halide employed in the step of growing the grains, and the like.

In the preparation of the tabular silver halide grains used in the present invention, it is possible to control the particle size, the shape of grains (ratio of diameter/-thickness, etc.), the distribution of the particle size and the growth rate of grains by using, if desired, a silver halide solvent. The amount of the solvent used is preferably in the range of about $10^{-3}$ to 1.0% by weight, particularly $10^{-2}$ to $10^{-1}$% by weight, based on the reaction solution.

For example, when the amount of the solvent is increased, the particle size distribution becomes uniform, i.e., "monodispersed" grains are obtained and the growth rate can be increased. On the other hand, the thickness of the grains tends to increase with an increase in the amount of the solvent used.

Silver halide solvents frequently employed include ammonia, thioethers, thioureas, etc. With respect to thioethers, the disclosure in U.S. Pat. Nos. 3,271,157, 3,790,387 and 3,574,628, etc. can be referred to.

These silver halide solvents are added during preparation of the tabular silver halide grains according to the present invention in order to increase the growth of the grains. Methods involving increasing the rate of addition, the amount of addition and the concentration of a silver salt solution (for example, an aqueous solution of silver nitrate) and a halide solution (for example, an aqueous solution of potassium bromide) are preferably used.

With respect to these methods, the disclosures in British Pat. No. 1,335,925, U.S. Pat. Nos. 3,672,900, 3,650,757 and 4,242,445, and Japanese Patent Application (OPI) Nos. 142329/80, 158124/80, 113927/83, 113928/83, 111934/83 and 111936/83 (the term "OPI", as used herein, refers to a "published unexamined Japanese patent application") contain teachings of such methods which can be used.

The tabular silver halide grains according to the present invention can be chemically sensitized, if desired.

Chemical sensitization can be carried out by a gold sensitization process using gold compounds as disclosed, for example, in U.S. Pat. Nos. 2,448,060 and 3,320,069, a sensitization process using metals such as iridium, platinum, rhodium or palladium as disclosed, for example, in U.S. Pat. Nos. 2,448,060, 2,566,245 and 2,566,263, a sulfur sensitization process using sulfur containing compounds as disclosed, for example, in U.S. Pat. No. 2,222,264 or a reduction sensitization process using tin salts or polyamines as disclosed, for example, in U.S. Pat. Nos. 2,487,850, 2,518,698 and 2,521,925, or a combination of two or more thereof.

Particularly, from the viewpoint of highly sensitizing the tabular silver halide grains according to the present invention, gold sensitization, sulfur sensitization or a combination thereof is preferably used.

In the layer containing tabular silver halide grains according to the present invention, the tabular grains having a ratio of diameter/thickness of 5 or more necessarily are present in an amount of 50% or more based on the total projected area of silver halide grains present in the layer. It is preferred that the tabular grains having a ratio of diameter/thickness of 5 or more be present in an amount of 50% or more of the total projected area of silver halide grains contained in the layer and that tabular grains having a ratio of diameter/thickness of 8 or more are present in an amount of not more than 50% of the total projected area.

The layer containing tabular silver halide grains preferably has a thickness in the range of from 0.3 to 6.0 μm, particularly from 0.5 to 4.0 μm.

The coating amount of the tabular silver halide grains is preferably in a range of from 0.1 to 6 g/m$^2$, particularly from 0.3 to 3 g/m$^2$.

The coating amount of total silver halide grains preferably is in a range of from 0.05 to 6.0 g/m$^2$, more preferably from 0.1 to 4.0 g/m$^2$ per each layer containing tabular silver halide grains.

In the case of applying the present invention to a multilayer color photographic light-sensitive material, the multilayer color photographic light-sensitive material has at least one red-sensitive emulsion layer, at least one green-sensitive emulsion layer and at least one blue-sensitive emulsion layer, but the order of these light-sensitive layers is not particularly restricted and can be suitably decided according to the purpose.

Further, as described hereinafter, dye forming couplers are employed in a silver halide color photographic material according to the present invention. Ordinarily, a cyan dye forming coupler is used for the red-sensitive layer, a magenta dye forming coupler is used for the green-sensitive layer and a yellow dye forming coupler is used for the blue-sensitive layer, but other combinations can be used according to the purpose.

The tabular silver halide emulsion according to the present invention may be used for any of the above described red-sensitive layer, green-sensitive layer and blue-sensitive layer. When these color-sensitive layers are composed of two or more light-sensitive layers, the tabular silver halide emulsion may be used for any layer thereof, but it is particularly preferred to use the tabular silver halide emulsion in at least the farthest silver halide emulsion layer from the support.

The effect of the present invention is most pronounced when the tabular silver halide emulsion is added to the blue-sensitive layer (the farthest blue-sensitive silver halide emulsion layer from the support when two or more blue-sensitive layers are present) and the blue-sensitive layer is placed at the outermost position with respect to the support as compared with the other color-sensitive layers.

In the case where the tabular silver halide emulsion according to the present invention is employed in the farthest light-sensitive layer from the support, the total thickness of one or more layers remoter from the support than the farthest light-sensitive layer preferably is in a range of from 0.3 to 6.0 μm, particularly from 0.5 to 4.0 μm.

The present invention can be applied to any color photographic light-sensitive materials, for example, color negative films, color reversal films (coupler-incorporated type or coupler-not-incorporated type), color paper, color positive films, color reversal paper, photographic materials for color diffusion transfer, photographic materials for dye transfer, etc., and any black-and-white photographic light-sensitive materials, for example, black-and-white negative film, black-and-white paper, X-ray films, lith films, etc.

In the photographic emulsion layer or layers of the photographic light-sensitive material according to the present invention, any of non-tabular silver bromide, silver iodobromide, siliver iodochlorobromide, silver chlorobromide and silver chloride may be used, as the silver halide, together with the tabular silver halide grains. A preferred non-tabular silver halide is silver iodobromide or siiver iodochlorobromide, each containing about 30 mol% or less of silver iodide. Silver iodobromide containing from about 0.5 mol% to about 10 mol% silver iodide is particularly preferred.

The non-tabular silver halide grains may have a regular crystal structure, for example, a cubic, octahedral or tetradecahedral structure, etc., an irregular crystal structure, for example, a spherical structure, etc., a crystal defect, for example, a twin plane, etc., or may have a composite structure thereof. In addition, mixtures of silver halide grains having different crystal structures may be used.

The particle size of non-tabular silver halide grains which can be used together with the tabular silver halide grains may be varied and the same can include from fine grains having a size of about 0.1 micron or less to large size grains having up to about a 10 micron diameter (projected area). Further, a monodispersed emulsion having a narrow particle size distribution and polydispersed emulsion having a broad particle size distribution may be used.

Silver halide photographic emulsions which can be used in the present invention can be prepared by known techniques such as the methods described in *Research Disclosure,* Vol. 176, No. 17643 (December 1978), pp. 22–23, "I. Emulsion Preparation and Types", and ibid, Vol. 187, No. 18716 (November 1979), page 648.

Photographic emulsions which are used in the present invention can be prepared by the methods described in, for example, P. Glafkides, *Chimie et Physique Photographique,* Paul Montel (1967), G. F. Duffin, Photographic Emulsion Chemistry, Focal Press (1966), and V. L. Zelikman et al., *Making and Coating of Photographic Emulsions,* Focal Press (1964). That is, any of an acid method, a neutral method, an ammonia method and so forth can be employed. in reacting a soluble silver salt and a soluble halide, any of a double jet method, a single jet method, a combination thereof and so forth can be employed. In addition, a method where particles are formed in the presence of an excess of silver ions (the so-called reverse mixing method) can be employed. As an embodiment of the double jet method, a method wherein the pAg in the liquid where the silver halide is formed is maintained constant, i.e., a so-called controlled double jet method, can be employed. In accordance with this method, a silver halide emulsion in which the crystal form is regular and the particle size is nearly uniform can be obtained.

Physical ripening can be carried out in the presence of known silver halide solvents such as ammonia, potassium rhodanide, and thioethers and thione compounds as described in U.S. Pat. No. 3,271,157, Japanese Patent Application (OPI) Nos. 12360/76, 82408/78, 144319/78, 100717/79 and 155828/79. In accordance with this method, a silver halide emulsion in which the crystal form is regular and the particle size distribution is nearly uniform can be obtained.

The aforementioned silver halide emulsion containing regular particles can be prepared by controlling the pAg and pH during the process of formation of the particles. Details are described in, for example, *Photographic Science and Engineering,* Vol. 6, pp. 159–165 (1962), *Journal of Photographic Science,* Vol. 12, pp. 242–251 (1964), U.S. Pat. No. 3,655,394 and British Pat. No. 1,413,748.

A typical example of a monodispersed emulsion is an emulsion in which the silver halide particles have an average particle diameter of more than about 0.1 micron and at least 95 wt% of the particles are within 40% of the average particle diameter. An emulsion in which the average particle diameter is 0.25 to 2 microns and at least 95 wt% or 95 numerical% of the silver halide particles are controlled within ±20% of the average particle diameter can also be used in the present invention. A method of preparation of such emulsions is described in U.S. Pat. Nos. 3,574,628 and 3,655,394 and British Pat. No. 1,413,748. In addition, monodispersed emulsions as described in Japanese Patent Application (OPI) Nos. 8600/73, 39027/76, 83097/76, 137133/78, 48521/79, 99419/79, 37635/83, and 49938/83 can be preferably used in the present invention.

The crystal structure of the silver halide may be uniform, or may be such that the halogen composition is different between the inside portion and the surface layer of the silver halide grains, or may have a laminar structure. These emulsion particles are described in British Pat. No. 1,027,146, U.S. Pat. Nos. 3,505,068 and 4,444,877 and Japanese Patent Application (OPI) No. 143331/85, etc. Silver halides having varied compositions which are joined together by epitaxial junction may be used, or silver halides joined to compounds other than silver halide may be used. Such emulsion particles are described, for example, in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962 and 3,852,067, and Japanese Patent Application (OPI) No. 162540/84.

In the course of the formation of silver halide particles and physical ripening, cadmium salts, zinc salts, thallium salts, iridium salts or complex salts thereof, rhodium salts or complex salts thereof, iron salts or complex salts thereof, and the like may be present.

The emulsion may be of the surface latent image type where a latent image is formed mainly on the surface thereof, or may be of the internal latent image type where a latent image is formed in the inside of the particles.

To remove a soluble silver salt from the emulsion before or after physical ripening, a noodle water washing method, a flocculation precipitation method, an ultrafiltration, and so forth can be employed.

The emulsion that is used in the present invention is usually subjected to physical ripening, chemical ripening and spectral sensitization. Additives used for these processes are described in the aforementioned references and *Research Disclosure,* No. 17643 (December 1978) and No. 18716 (November 1979). The type of the additive and the pages at which disclosure regarding the additive appears are shown in the Table below.

Known photographic additives which can be used in the present invention are also described in the above references, and the type of the additive and the pages at which disclosure regarding the additive appears are shown in the Table below.

TABLE

| Type of Additive | RD17643* | RD18716* |
|---|---|---|
| 1. Chemical sensitizing agent | p. 23 | p. 648, right column |
| 2. Sensitivity increasing agent | " | " |
| 3. Spectral sensitizing agent Supersensitizing agent | pp. 23–24 | p. 648, right column to p. 649, right column |
| 4. Whitening agent | p. 24 | |
| 5. Antifoggant and stabilizer | pp. 24–25 | p. 649, right column |
| 6. Light absorbing agent, filter dye, ultraviolet absorber | pp. 25–26 | p. 649, right column to p. 650, left column |
| 7. Stain preventing agent | p. 25, right column | p. 650, left column to right column |
| 8. Dye image stabilizer | p. 25 | |
| 9. Hardening agent | p. 26 | p. 651, left column |
| 10. Binder | p. 26 | " |
| 11. Plasticizer, lubricant | p. 27 | p. 650, right column |
| 12. Coating aid, surface active agent | pp. 26–27 | " |
| 13. Antistatic agent | p. 27 | " |

*Research Disclosure

Various color couplers can be used in the present invention. Representative examples of the color couplers are described in the patents listed in the aforementioned reference, *Research Disclosure,* No. 17643, Clauses VII-C to G. As dye-forming couplers, couplers producing three primary colors (i.e., yellow, magenta and cyan) per the subtractive method through color development are important. As representative examples of hydrophobic, 4-equivalent or 2-equivalent couplers which are diffusion resistant, in addition to the couplers described in the patents listed in the aforementioned reference, *Research Disclosure,* No. 17643, Clauses VII-C and D, the following are preferably used in the present invention.

Typical examples of yellow couplers which can be used in the present invention are hydrophobic acylacetamide based couplers containing a ballast group. Representative examples of such couplers are described, for example, in U.S. Pat. Nos. 2,407,210, 2,875,057 and 3,265,506. In the present invention, it is preferred to use 2-equivalent yellow couplers. Typical examples of such yellow couplers are oxygen atom-releasing type yellow couplers as described in U.S. Pat. Nos. 3,408,194, 3,447,928, 3,933,501 and 4,022,620, and nitrogen atom-releasing type yellow couplers as described in Japanese Patent Publication No. 10739/83, U.S. Pat. Nos. 4,401,752, 4,326,024, *Research Disclosure,* No. 18053 (April 1979), British Pat. No. 1,425,020, and West German Patent Application (OLS) Nos. 2,219,917, 2,261,361, 2,329,587 and 2,433,812. α-Pivaloylacetanilide based couplers produce dyes which are excellent in fastness, particularly light fastness. On the other hand, α-benzoylacetanilide based couplers provide a high color density.

As magenta couplers, couplers which are hydrophobic and have a ballast group, such as indazolone- or cyanoacetyl-based couplers, preferably 5-pyrazolone- and pyrazoloazole-based couplers, are typically used. 5-Pyrazolone-based couplers which are substituted with an arylamino group or acylamino group in the 3-position are preferred form the standpoints of the hue of the colored dye and color density. Typical examples are described in U.S. Pat. Nos. 2,311,082, 2,343,703, 2,600,788, 2,908,573, 3,062,653, 3,152,896 and 3,936,015. As releasing groups of 2-equivalent 5-pyrazolone-based couplers, nitrogen atom releasing groups and an arylthio group as described in U.S. Pat. No. 4,351,897 are particularly preferred. 5-Pyrazolone-based couplers having a ballast group as described in European Pat. No. 73,636 provide high color density. As pyrazoloazole-based couplers, pyrazolobenzimidazoles as described in U.S. Pat. No. 3,061,432, preferably pyrazolo[5,1-c][1,2,4]triazoles, hydrotetrazoles are described in *Research Disclosure,* No. 24220 (June 1984) and Japanese Patent Application (OPI) No. 33552/85, and pyrazolopyrazoles as described in *Research Disclosure,* No. 24230 (June 1984) and Japanese Patent Application (OPI) No. 43659/85 are illustrative. In view of the decreased yellow sub-absorption of the colored dye formed and light fastness, imidazo[1,2-b]pyrazoles as described in U.S. Pat. No. 4,500,630 are preferred, and pyrazolo[1,5-b][1,2,4]triazole are particularly preferred.

Cyan couplers which can be used in the present invention include hydrophobic, anti-diffusing naphthol- and phenol-based couplers. Typical examples are naphthol-based couplers as described in U.S. Pat. No. 2,474,293, preferably 2-equivalent naphthol-based couplers of the oxygen atom releasing type as described in U.S. Pat. Nos. 4,052,212, 4,146,396, 4,228,233 and 4,296,200. Representative examples of phenol-based couplers are described in U.S. Pat. Nos. 2,369,929, 2,801,171, 2,772,162 and 2,895,826.

Cyan couplers which are resistant to humidity and temperature are preferably used in the present invention. Typical examples of such couplers are phenol-based cyan couplers having an alkyl group (having two or more carbon atoms) in the meta-position of the phenol nucleus as described in U.S. Pat. No. 3,772,002, 2,5-diacylamino substituted phenol-based couplers as described in U.S. Pat. Nos. 2,772,162, 3,758,308, 4,126,396, 4,334,011 and 4,327,173, West German Patent Application (OLS) No. 3,329,729 and European Pat. No. 121,365, and phenol-based couplers having a phenylureido group in the 2-position and an acylamino group in the 5-position as described in U.S. Pat. Nos. 3,446,622, 4,333,999, 4,451,559, and 4,427,767.

In order to correct unnecessary or undesired absorption of the dyes formed, it is preferred to apply masking to a color negative light-sensitive material for camera use by using a colored coupler in combination. Typical examples are yellow colored magenta couplers as described in U.S. Pat. No. 4,163,670 and Japanese Patent Publication No. 39413/82, and magenta colored cyan couplers as described in U.S. Pat. Nos. 4,004,929 and 4,138,258 and British Pat. No. 1,146,368. Other useful colored couplers are described in the aforementioned reference, *Research Disclosure,* No. 17643, Clause VII-G.

Granularity can be improved by using an combination those couplers capable of producing colored dyes having suitable diffusibility. In connection with such couplers, representative examples of magenta couplers are described in U.S. Pat. No. 4,366,237 and British Pat. No. 2,125,570, and representative examples of yellow, magenta and cyan couplers are described in European Pat. No. 96,570 and West German Patent Application (OLS) No. 3,234,533.

The aforementioned dye forming couplers may be in the form of dimers or higher polymers. Typical examples of polymerized dye forming couplers are described in U.S. Pat. Nos. 3,451,820 and 4,080,211. Representative examples polymerized magenta couplers are described in British Pat. No. 2,102,173 and U.S. Pat. No. 4,367,282.

Couplers releasing a photographically useful groups upon coupling are also preferably used in the present invention. Of DIR couplers releasing a development inhibitor, couplers described in the patents listed in the aforementioned reference, *Research Disclosure,* No. 17643, Clauses VII-F are useful.

Preferably used in combination with the present invention are couplers of the developer deactivating type as described in Japanese Patent Application (OPI) No. 151944/82; couplers of the timing type as described in U.S. Pat. No. 4,248,962 and Japanese Patent Application (OPI) No. 154234/82; couplers of the type as described in Japanese Patent Application (OPI) No. 184248/85. Particularly preferred are DIR couplers of the developer deactivating type as described in Japanese Patent Application (OPI) Nos. 151944/82, 217932/83, Japanese Patent Application (OPI) Nos. 218644/85, 225148/85, 225156/85, 233650/85, and DIR couplers of the reaction type as described in Japanese Patent Application (OPI) No. 184248/85.

Couplers which are used in the present invention can be incorporated in the light-sensitive material by various known dispersion methods such as a solid dispersion method, an alkali dispersion method, preferably a latex dispersion method, and more preferably an oil-in-water dispersion method. In the oil-in-water dispersion method, a coupler is dissolved in a high boiling point organic solvent having a boiling point of not less than 175° C. such as dibutyl phthalate, bis(2-ethylhexyl)phthalate, triphenyl phosphate, tricresyl phosphate, N,N-dimethyllaurylamide, etc. and/or a so-called auxiliary solvent having a low boiling point such as ethyl acetate, methyl ethyl ketone, cyclohexanone, N,N-dimethylformamide, etc., and then typically finely dispersed in an aqueous medium such as water or an aqueous gelatin solution in the presence of one or more surface active agents. Examples of such high boiling point organic solvents are described, for example, in U.S. Pat. No. 2,322,027. In this dispersion, phase conversion may be present. If desired or necessary, coating may be conducted after removing or decreasing the auxiliary solvent by techniques such as distillation, noodle water washing and ultrafiltration.

The process and effect of the latex dispersion method, and representative examples of latexes for impregnation are described, for example, in U.S. Pat. No. 4,199,363 and West German Patent Application (OLS) Nos. 2,541,274 and 2,541,230.

The light-sensitive material of the present invention may contain, as anti-color foggants and color mixing preventing agents, hydroquinone derivatives, aminophenol derivatives, amines, gallic acid derivatives, catechol derivatives, ascorbic acid derivatives, non-color forming couplers, and sulfonamidophenol derivatives.

In the light-sensitive material of the present invention, various fading preventing agents can be used. Typical examples of such organic fading preventing agents are hydroquinones, 6-hydroxychromans, 5-hydroxycumaranes, spirochromans, p-alkoxyphenols, hindered phenols containing bisphenols in the center thereof, gallic acid derivatives, methylenedioxybenzenes, aminophenols, hindered amines and their ether or ester derivatives in which the phenolic hydroxyl group is silylated or alkylated. In addition, metal complexes such as a (bis-salicylaldoximato) nickel complex and a (bis-N,N-dialkyldithiocarbamido) nickel complex can be used.

The present invention is applicable to a multilayer natural color photographic material comprising a support and at least one red-sensitive emulsion layer, at least one green-sensitive emulsion layer and at least one blue-sensitive emulsion layer on the support. The order in which the above emulsions are provided is not critical and can be determined appropriately depending on the purpose of use.

Preferred layer arrangements are such that a red-sensitive emulsion layer, a green-sensitive emulsion layer and a blue-sensitive emulsion layer are provided on a support in this sequence, or such that a blue-sensitive emulsion layer, a red-sensitive emulsion layer and a green-sensitive emulsion layer are provided on a support in this sequence. The foregoing emulsion may each be composed of two or more unit emulsion layers having different sensitivities, and a light-insensitive layer may be present between two or more unit emulsion layers having the same spectral sensitivity. Usually a cyan-forming coupler is incorporated in the red-sensitive emulsion layer; a magenta-forming coupler, in the green-sensitive emulsion layer; and a yellow-forming coupler, in the blue-sensitive emulsion layer. In some cases, different combinations can be used.

In the light-sensitive material of the present invention, it is preferred that as well as the aforementioned silver halide emulsion layer, auxiliary layers such as a protective layer, an intermediate layer, a filter layer, an anti-halation layer, and a back layer be appropriately provided, depending on the purpose of use.

In the photographic material of the present invention, photographic emulsion layers and other layers are coated on a support commonly used in photographic materials, such as a flexible support (e.g., a plastic film, paper, and cloth) and a rigid support (e.g., glass, porcelain and metal). Useful examples of such flexible supports are films or cellulose derivatives (e.g., cellulose nitrate, cellulose acetate and cellulose acetate butyrate), or synthetic polymers (e.g., polystyrene, polyvinyl chloride, polyethylene terephthalate and polycarbonate), and paper laminated or coated with a baryta layer or an $\alpha$-olefin polymer(s)) (e.g., polyethylene, polypropylene and an ethylene/butene copolymer). The support may be colored with dyes or pigments. For the purpose of light shielding, the support may be colored black. The surface of the support is usually subjected to an undercoating treatment for the purpose of strengthening adhesion to the photographic emulsion layer and so forth. The support surface may be subjected to treatments such as glow discharge, corona discharge, irradiation with ultraviolet rays and flame treatment before or after the undercoating treatment.

In coating hydrophilic colloid layers such as the photographic emulsion layer, various known coating methods such as dip coating, roller coating, curtain coating and extrusion coating can be employed. If necessary, a plurality of layers may be coated by coating methods as described in U.S. Pat. Nos. 2,681,294, 2,761,791, 3,526,528 and 3,508,947.

The color photographic material of the present invention can be developed by conventional methods as described in the aforementioned references, *Research Disclosure,* No. 17643, pp. 28–29 and *Research Disclosure,* No. 18716, page 651, left column to right column. The color photographic material of the present invention is usually subjected to water washing or stabilization after development, bleach-fixing or fixing.

In the washing step, countercurrent washing using two or more vessels are usually used to save water. A typical example of the stabilization is a multi-stage countercurrent stabilization as described in Japanese Patent Application (OPI) No. 8543/82. E.g., 2 to 9 vessels (countercurrent baths) are generally needed. To the stabilization bath are added various compounds for the purpose of stabilizing an image. Typical examples of such compounds are various buffers for adjusting the film pH (for example, to a pH of 3 to 8), such as boric acid salts, metaboric acid salts, borax, phosphoric acid salts, carbonic acid salts, potassium hydroxide, sodium hydroxide, ammonia water, monocarboxylic acid(s), dicarboxylic acid(s) and polycarboxylic acid(s), which can be used in combination with one another, and formalin. In addition, if desired or necessary, a hard water softening agent (e.g., inorganic phosphoric acid, aminopolycarboxylic acid, aminopolyphosphonic acid and phosphonocarboxylic acid), a bactericide (e.g., benzoisothiazolinones, isothiazolones, 4-thiazolinebenzimidazoles, and halogenated phenols), a surface active agent, a fluorescent brightener, and a hardener, and other additives may be used. Two or more of such compounds which are used for different purposes may be used in combination.

Preferably, as film pH-adjusting agents used after processing, various ammonium salts such as ammonium chloride, ammonium nitrate, ammonium sulfate, ammonium phosphate, ammonium sulfite, and ammonium thiosulfate are added.

The present invention is now described in detail with reference to the following examples, but the present invention is not to be construed as being limited thereto.

Tabular silver halide emulsion were prepared in the manner as described below.

30 g of gelatin and 10.3 g of potassium bromide were added to 1 liter of water and the resulting solution was kept in a vessel at 60° C. (pBr: 1.3, pH: 6.5) with stirring. Solutions I and II shown in Table 1 below were then added thereto at the same time over a period of 15 seconds with stirring, and then Solutions III and IV shown in Table 1 below were added at the same time over a period of 65 minutes by a double jet process. Solution V shown in Table 1 was added at the same time over a period of 15 minutes during the addition of Solutions III and IV. Addition of Solutions III, IV and V started simultaneously.

After completing the addition of the above solutions, the emulsion was ripened for 10 minutes with the addition of 1 g of sodium thiocyanate.

In the tubular silver halide grain emulsion thus obtained, grains having a diameter/thickness ratio of 7 or more occupied 50% of the total projected area of the silver halide grains present in the emulsion; the average thickness of the grains was 0.13 μm and the silver iodide content was 2.5 mol%. This emulsion was subjected to chemical sensitization using gold and sulfur. The tabular silver halide emulsion thus prepared was designated Emulsion A.

TABLE 1

| | | Solution I | Solution II | Solution III | Solution IV | Solution V |
|---|---|---|---|---|---|---|
| $AgNO_3$ | (g) | 4.5 | — | 95.5 | — | — |
| $H_2O$ | (cc) | 30 | 26.7 | 561 | 542 | 100 |
| KBr | (g) | — | 3.15 | — | 69.6 | — |
| KI | (g) | — | — | — | — | 2.5 |

In the same manner as described for Emulsion A except changing the pBr to 1.0, Emulsion B was prepared was a tabular silver halide emulsion where grains having a diameter/thickness ratio of 9 or more occupied 60% of the total projected area of the silver halide grains present in the emulsion; the average thickness of the grains was 0.10 μm and the silver iodide content was 2.5 mol%.

For comparison with Emulsions A and B, a spherical silver iodobromide emulsion (silver iodide content of 2.5 mol%) was prepared in the presence of ammonia by a double jet process. The emulsion grains thus obtained had an average particle size of 0.7 μm. The emulsion was subjected to chemical sensitization using gold and sulfur. The resulting emulsion was designated Emulsion C.

In the same manner as described for Emulsion A except changing the pBr to 1.7, Emulsion D was prepared which was a tabular silver halide emulsion where grains having a diameter/thickness ratio of 5 or more occupied 40% of the total projected area of the silver halide grains present in the emulsion; the average thickness of the grains was 0.16 μm and the silver iodide content was 2.5 mol%.

EXAMPLE 1

Preparation of Sample 101

On a triacetate film support were coated layers having the compositions shown below to prepare a multilayer color photographic light-sensitive material which was designated Sample 101.

First Layer: Antihalation Layer

A gelatin layer (dry layer thickness of 2 μm) containing:
Black colloidal silver: 0.25 g/m$^2$
Ultraviolet Ray Absorbing Agent U-1: 0.04 g/m$^2$
Ultraviolet Ray Absorbing Agent U-2: 0.1 g/m$^2$
Ultraviolet Ray Absorbing Agent U-3: 0.1 g/m$^2$
High Boiling Point Organic Solvent O-1: 0.1 cc/m$^2$ Second Layer: Intermediate Layer A gelatin layer (dry layer thickness of 1 μm) containing:
Compound H-1: 0.05 g/m$^2$
High Boiling Point Organic Solvent O-2: 0.05 cc/m$^2$ Third Layer: First Red-Sensitive Emulsion Layer A gelatin layer (dry layer thickness of 1 μm) containing:
Silver iodobromide emulsion (tetrahedral grains, iodide content: 4 mol%, average particle size: 0.3

μm), silver coated amount: 0.5 g/m²
Sensitizing Dye S-1: 1.4 mg/m²
Sensitizing Dye S-2: 0.06 mg/m²
Coupler C-1: 0.2 g/m²
Coupler C-2: 0.05 g/m²
High Boiling Point Organic Solvent O-2: 0.12 cc/m²

Fourth Layer: Second Red-Sensitive Emulsion Layer

A gelatin layer (dry layer thickness of 2.5 μm) containing:
Silver iodobromide emulsion (spherical grains, iodide content: 2.5 mol%, average particle size: 0.55 μm), silver coated amount: 0.8 g/m²
Sensitizing Dye S-1: 1.6 mg/m²
Sensitizing Dye S-2: 0.06 mg/m²
Coupler C-1: 0.55 g/m²
Coupler C-2: 0.14 g/m²
High Boiling Point Organic Solvent O-2: 0.33 cc/m²

Fifth Layer: Intermediate Layer

A gelatin layer (dry layer thickness of 1 μm) containing:
Compound H-1: 0.1 g/m²
High Boiling Point Organic Solvent O-2: 0.1 cc/m²

Sixth Layer: First Green-Sensitive Emulsion Layer

A gelatin layer (dry layer thickness of 1 μm) containing:
Silver iodobromide emulsion (tetrahedral grains, iodide content: 3 mol%, average particle size: 0.3 μm), silver coated amount: 0.7 g/m²
Sensitizing Dye S-3: 3.3 mg/m²
Sensitizing Dye S-4: 1.5 mg/m²
Coupler C-3: 0.35 g/m²
High Boiling Point Organic Solvent O-2: 0.26 cc/m²

Seventh Layer: Second Green-Sensitive Emulsion Layer

A gelatin layer (dry layer thickness of 2.5 μm) containing:
Silver Iodobromide Emulsion C (spherical grains), silver coated amount: 0.7 g/m²
Sensitizing Dye S-3: 1.3 mg/m²
Sensitizing Dye S-4: 0.5 mg/m²
Coupler C-4: 0.25 g/m²
High Boiling Point Organic Solvent O-2: 0.05 cc/m²

Eighth Layer: Intermediate Layer

A gelatin layer (dry layer thickness of 1 μm) containing:
Compound H-1: 0.05 g/m²
High Boiling Point Organic Solvent O-2: 0.1 cc/m²

Ninth Layer: Yellow Filter Layer

A gelatin layer (dry layer thickness of 1 μm) containing:
Yellow colloidal silver: 0.1 g/m²
Compound H-1: 0.02 g/m²
Compound H-2: 0.03 g/m²
High Boiling Point Organic Solvent O-2: 0.04 cc/m²

Tenth Layer: First Blue-Sensitive Emulsion Layer

A gelatin layer (dry layer thickness of 1.5 μm) containing:
Silver iodobromide emulsion (spherical grains, iodide content: 2.5 mol%, average particle size: 0.7 μm), silver coated amount: 0.6 g/m²
Sensitizing Dye S-5: 1.0 mg/m²
Coupler C-5: 0.5 g/m²
High Boiling Point Organic Solvent O-2: 0.1 cc/m²

Eleventh Layer: Second Blue-Sensitive Emulsion Layer

A gelatin layer (dry layer thickness of 3 μm) containing:
Silver Iodobromide Emulsion C (spherical grains), silver coated amount: 1.1 g/m²
Sensitizing Dye S-5: 1.7 mg/m²
Coupler C-5: 1.2 g/m²
High Boiling Point Organic Solvent O-2: 0.23 cc/m²

Twelfth Layer: First Protective Layer

A gelatin layer (dry layer thickness of 1 μm) containing:
Ultraviolet Ray Absorbing Agent U-1: 0.02 g/m²
Ultraviolet Ray Absorbing Agent U-2: 0.03 g/m²
Ultraviolet Ray Absorbing Agent U-3: 0.03 g/m²
Ultraviolet Ray Absorbing Agent U-4: 0.29 g/m²
High Boiling Point Organic Solvent O-1: 0.28 cc/m²

Thirteenth Layer: Second Protective Layer

A gelatin layer (dry layer thickness of 0.8 μm) containing:
A surface-fogged, fine grain silver iodobromide emulsion (iodide content: 1 mol%, average particle size: 0.06 μm), silver coated amount: 0.1 g/m²
Polymethyl methacrylate particles (average particle size: 1.5 μm): 0.05 g/m²

Gelatin Hardener H-3 and a surface active agent were incorporated into each of the layers in addition to the above described components.

The compounds employed for the preparation of the sample are illustrated below.

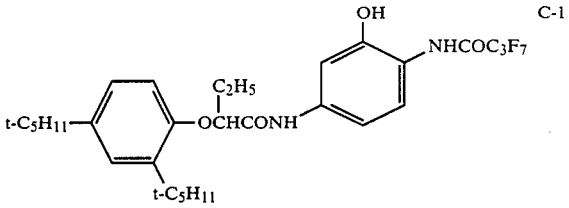

C-1

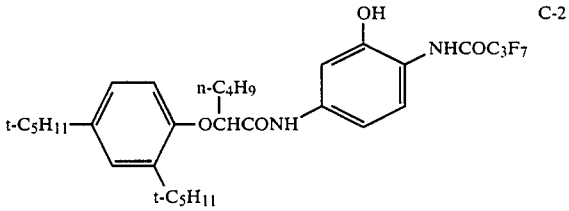

C-2

-continued
C-3
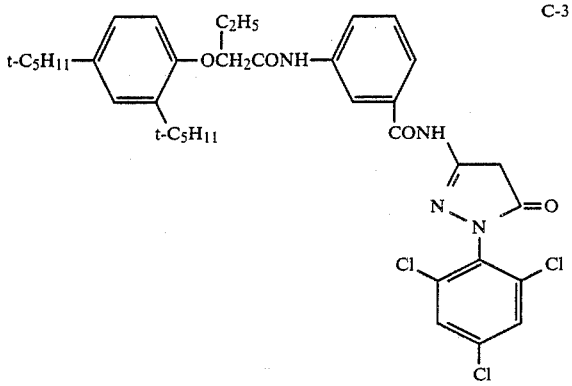
C-4
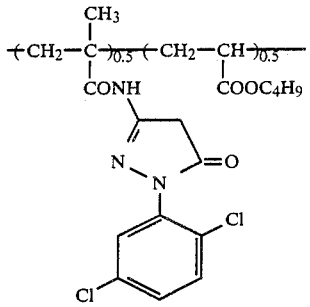
C-5
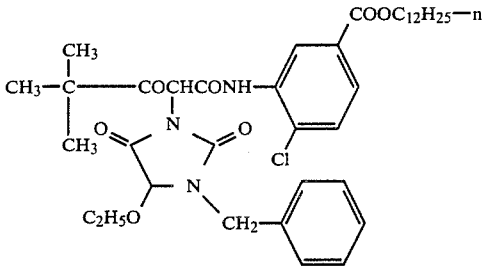
U-1
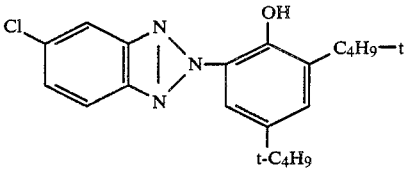
U-2
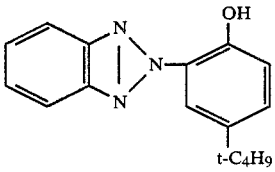
U-3
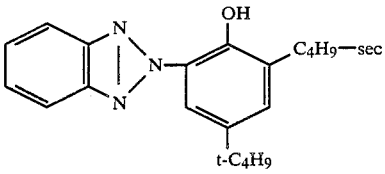
U-4
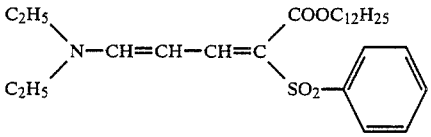
-continued
H-1
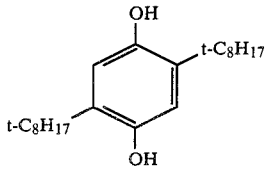
H-2
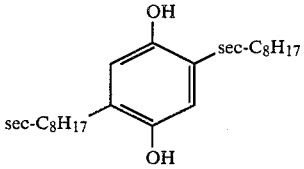
H-3
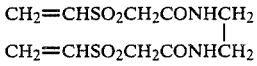
O-1
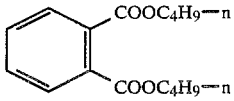
O-2
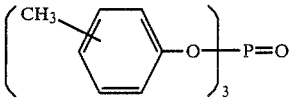
S-1
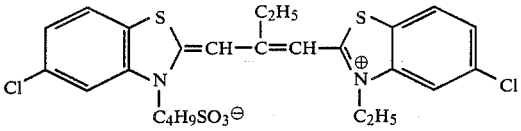
S-2
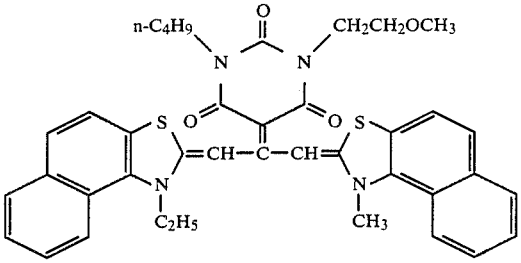
S-3
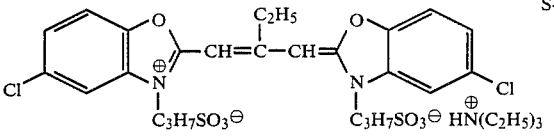
S-4
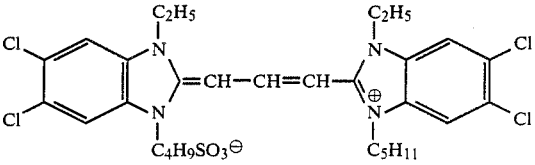

-continued

S-5

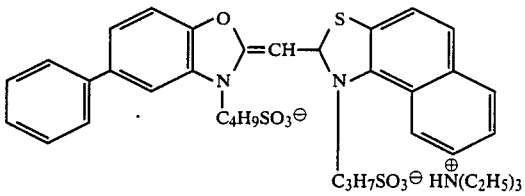

Preparation of Sample 102

Sample 102 was prepared in the same manner as described for Sample 101 except using Emulsion D in place of Emulsion C in the eleventh layer of Sample 101.

Preparation of Samples 103 and 104

Samples 103 and 104 were prepared in the same manner as described for Sample 101 except using Emulsions A and B, respectively, in place of Emulsion C in the eleventh layer of Sample 101.

Preparation of Samples 105 and 106

Samples 105 and 106 were prepared in the same manner as described for Sample 101 except adding the compound shown in Table 2 below to the third layer, the tenth layer and the eleventh layer of Sample 101 in the amount shown in Table 2 below.

Preparation of Samples 107 to 110

Samples 107 and 110 were prepared in the same manner as described for Sample 102 except adding the compound shown in Table 2 below to the third layer, the tenth layer and the eleventh layer of Sample 102 in the amount shown in Table 2 below.

Preparation of Samples 111, 112 and 114 to 120

Samples 111, 112 and 114 to 120 were prepared in the same manner as described for Sample 103 except adding the compound shown in Table 2 below to the third layer, the tenth layer and the eleventh layer of Sample 103 in the amount shown in Table 2 below.

Preparation of Sample 121

Sample 121 was prepared in the same manner as described for Sample 103 except adding the compound shown in Table 2 below to the second layer, the ninth layer and the eleventh layer of Sample 103 in the amount shown in Table 2 below.

Preparation of Samples 113, 122 and 123

Samples 113, 122 and 123 were prepared in the same manner as described for Sample 104 except adding the compound shown in Table 2 below to the third layer, the tenth layer and the eleventh layer for Sample 104 in the amount shown in Table 2 below.

With respect to each of Samples 101 to 123 thus prepared, sharpness was measured using an MTF value (The Theory of the Photographic Process, 4th ed., p. 604, Macmillan Pub. Co., Inc. (1977)). The results obtained are shown in Table 2 below.

The development processing of the samples was conducted using the processing steps and processing solutions as follows.

| Processing Steps | Time (min) | Temperature |
|---|---|---|
| First development | 6 | 38° C. |
| Washing with water | 2 | " |
| Reversing | 2 | " |
| Color development | 6 | " |
| Conditioning | 2 | " |
| Bleaching | 6 | " |
| Fixing | 4 | " |
| Washing with water | 4 | " |
| Stabilizing | 1 | Normal temperature |
| Drying | | |

The composition of each processing solution used was as follows.

First Developing Solution

Water: 700 ml
Pentasodium salt of nitrilo-N,N,N-trimethylenephosphonic acid: 3 g
Sodium sulfite: 20 g
Hydroquinone monosulfonate: 30 g
Sodium carbonate (monohydrate): 30 g
1-Phenyl-4-methyl-4-hydroxymethyl-3-pyrazolidone: 2 g
Potassium bromide: 2.5 g
Potassium thiocyanate: 1.2 g
Potassium iodide (0.1 wt% solution): 2 ml
Water to make: 1,000 ml Reversing Solution Water: 700 ml
Pentasodium salt of nitrilo-N,N,N-trimethylenephosphonic acid: 3 g
Stannous chloride (dihydrate): 1 g
p-Aminophenol: 0.1 g
Sodium hydroxide: 8 g
Glacial acetic acid: 15 ml
Water to make: 1,000 ml Color Developing Solution Water: 700 ml
Pentasodium salt of nitrilo-N,N,N-trimethylenephosphonic acid: 3 g
Sodium sulfite: 7 g
Sodium tertiary phosphate (decahydrate): 36 g
Potassium bromide: 1 g
Potassium iodide (0.1 wt% solution): 90 ml
Sodium hydroxide: 3 g
Citrazinic acid: 1.5 g
N-Ethyl-N-(β-methanesulfonamidoethyl)-3-methyl-4-aminoaniline sulfate: 11 g
Ethylenediamine: 3 g
Water to make: 1,000 ml Conditioning Solution Water: 700 ml
Sodium sulfite: 12 g
Sodium ethylenediaminetetraacetate (dihydrate): 8 g
Thioglycerol: 0.4 ml
Glacial acetic acid: 3 ml
Water to make: 1,000 ml Bleaching Solution Water: 800 ml
Sodium ethylenediaminetetraacetate (dihydrate): 2 g
Iron (III) ammonium ethylenediaminetetraacetate (dihydrate): 120 g
Potassium bromide: 100 g
Water to make: 1,000 ml Fixing Solution Water: 800 ml
Ammonium thiosulfate: 80 g
Sodium sulfite: 5 g
Sodium bisulfite: 5 g
Water to make: 1,000 ml Stabilizing Solution Water: 800 ml
Formalin (37 wt%): 5 ml
Fuji Driwel (a surface active agent manufactured by Fuji Photo film Co., Ltd.): 5 ml
Water to make: 1,000 ml

TABLE 2

| Sample No. | Emulsion in Eleventh Layer | Compound Added | Layer Added to | Amount Added per Layer (mol/m$^2$) | Sharpness: Yellow Image 5 cycles/mm | Sharpness: Yellow Image 30 cycles/mm | Sharpness: Cyan Image 5 cycles/mm | Sharpness: Cyan Image 30 cycles/mm |
|---|---|---|---|---|---|---|---|---|
| 101 (Comparison) | Emulsion C | — | — | — | 0.86 | 0.71 | 0.77 | 0.55 |
| 102 (Comparison) | Emulsion D | — | — | — | 0.84 | 0.73 | 0.75 | 0.57 |
| 103 (Comparison) | Emulsion A | — | — | — | 0.83 | 0.78 | 0.74 | 0.63 |
| 104 (Comparison) | Emulsion B | — | — | — | 0.82 | 0.78 | 0.72 | 0.63 |
| 105 (Comparison) | Emulsion C | Compound D | 3rd, 10th 11th Layers | $2 \times 10^{-6}$ | 0.87 | 0.71 | 0.77 | 0.55 |
| 106 (Comparison) | " | (3) | " | " | 0.94 | 0.71 | 0.86 | 0.55 |
| 107 (Comparison) | Emulsion D | Compound D | " | " | 0.85 | 0.73 | 0.76 | 0.57 |
| 108 (Comparison) | " | Compound E | " | " | 0.84 | 0.73 | 0.75 | 0.57 |
| 109 (Comparison) | " | (3) | " | " | 0.93 | 0.74 | 0.85 | 0.57 |
| 110 (Comparison) | " | (11) | " | " | 0.92 | 0.73 | 0.84 | 0.57 |
| 111 (Comparison) | Emulsion A | Compound D | " | " | 0.83 | 0.78 | 0.75 | 0.63 |
| 112 (Comparison) | " | Compound E | " | " | 0.83 | 0.78 | 0.75 | 0.63 |
| 113 (Comparison | Emulsion B | Compound D | " | " | 0.82 | 0.78 | 0.72 | 0.63 |
| 114 (Comparison) | Emulsion A | (3)* | " | " | 0.94 | 0.81 | 0.86 | 0.65 |
| 115 | " | (11) | " | " | 0.93 | 0.80 | 0.85 | 0.64 |
| 116 | " | (20) | " | " | 0.93 | 0.80 | 0.85 | 0.64 |
| 117 | " | (29) | " | " | 0.93 | 0.80 | 0.85 | 0.64 |
| 118 | " | (40) | " | " | 0.93 | 0.80 | 0.85 | 0.64 |
| 119 | " | (46) | " | " | 0.93 | 0.80 | 0.85 | 0.64 |
| 120 | " | (52) | " | " | 0.93 | 0.80 | 0.85 | 0.64 |
| 121 | " | (3) | 2nd, 9th, 10th Layers | " | 0.93 | 0.79 | 0.84 | 0.63 |
| 122 | Emulsion B | (3) | 3rd, 10th, 11th Layers | " | 0.94 | 0.79 | 0.83 | 0.64 |
| 123 | Emulsion D | (11) | " | " | 0.93 | 0.79 | 0.83 | 0.64 |

*All as earlier identified in the Specification.

Compound D:

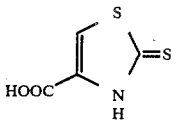

(compound described in Japanese Patent Publication No. 12677/71)

Compound E:

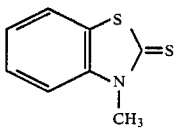

(compound described in Japanese Patent Publication No. 34169/73)

From the results shown in Table 2 above it can be understood that both sharpness at 5 cycles/mm and sharpness at 30 cycles/mm are effectively improved by the combination of the specified tabular silver halide grains and the specific compound according to the present invention. More specifically, the decrease in the MTF value at 5 cycles/mm due to the tabular grains as compared with spherical grains (Sample 101) is prevented by using a compound represented by the general formulae (I), (II), (III) and (IV). Further, the present invention provides almost the same sharpness at 5 cycles/mm and extremely good sharpness at 30 cycles/mm in comparison with the case where the compound represented by general formulae (I), (II), (III) and (IV) is used in combination with spherical grains (Sample 106).

EXAMPLE 2

Preparation of Sample 201

On a triacetate film support there were coated the layers having the compositions shown below to prepare a multilayer color photographic light-sensitive material which was designated Sample 201.

First Layer: Antihalation Layer

A gelatin layer containing:
Black colloidal silver: 0.18 g/m$^2$

Second Layer: Intermediate Layer

A gelatin layer containing:
2,5-Di-tert-pentadecylhydroquinone: 0.18 g/m$^2$
Coupler C-3: 0.11 g/m$^2$ Third Layer: First Red-Sensitive Emulsion Layer A gelatin layer containing:
Silver Iodobromide Emulsion A, silver coated amount: 0.72 g/m$^2$
Sensitizing Dye A: $9.0\times10^{-5}$ mol per mol of silver
Sensitizing Dye B: $3.0\times10^{-5}$ mol per mol of silver
Sensitizing Dye C: $4.2\times10^{-4}$ mol per mol of silver
Sensitizing Dye D: $3.0\times10^{-5}$ mol per mol of silver
Coupler C-4: 0.093 g/m$^2$
Coupler C-5: 0.31 g/m$^2$
Coupler C-6: 0.01 g/m$^2$ Fourth Layer: Second Red-Sensitive Emulsion Layer A gelatin layer containing:
Silver iodobromide emulsion (iodide content: 10 mol%, average particle size: 1.0 μm), silver coated amount: 1.2 g/m$^2$
Sensitizing Dye A: $7.8\times10^{-5}$ mol per mol of silver
Sensitizing Dye B: $2.2\times10^{-5}$ mol per mol of silver
Sensitizing Dye C: $3.0\times10^{-4}$ mol per mol of silver
Sensitizing Dye D: $2.2\times10^{-5}$ mol per mol of silver
Coupler C-4: 0.1 g/m$^2$
Coupler C-5: 0.061 g/m$^2$
Coupler C-7: 0.046 g/m$^2$ Fifth Layer: Third Red-Sensitive Emulsion Layer A gelatin layer containing:
Silver iodobromide emulsion (iodide content: 10 mol%, average particle size: 1.5 μm), silver coated amount: 1.5 g/m$^2$
Sensitizing Dye A: $8.0\times10^{-5}$ mol per mol of silver
Sensitizing Dye B: $2.4\times10^{-5}$ mol per mol of silver
Sensitizing Dye C: $3.3\times10^{-5}$ mol per mol of silver
Sensitizing Dye D: $2.4\times10^{-5}$ mol per mol of silver
Coupler C-7: 0.32 g/m$^2$
Coupler C-17: 0.001 g/m$^2$ Sixth Layer: Intermediate Layer A gelatin layer Seventh Layer: First Green-Sensitive Emulsion Layer A gelatin layer containing:
silver iodobromide emulsion (iodide content: 5 mol%, average particle size: 0.5 μm), silver coated amount: 0.5 g/m$^2$
Sensitizing Dye E: $3.8\times10^{-4}$ mol per mol of silver
Sensitizing Dye G: $1.5\times10^{-4}$ mol per mol of silver
Coupler C-8: 0.29 g/m$^2$
Coupler C-3: 0.04 g/m$^2$
Coupler C-10: 0.055 g/m$^2$
Coupler C-11: 0.058 g/m$^2$ Eighth Layer: Second Green-Sensitive Emulsion Layer A gelatin layer containing:
Silver iodobromide emulsion (spherical grains, iodide content: 6 mol%, average particle size: 1.2 μm), silver coated amount: 0.9 g/m$^2$
Sensitizing Dye E: $2.7\times10^{-4}$ mol per mol of silver
Sensitizing Dye G: $1.1\times10^{-4}$ mol per mol of silver
Coupler C-8: 0.25 g/m$^2$
Coupler C-3: 0.013 g/m$^2$
Coupler C-10: 0.009 g/m$^2$
Coupler C-11: 0.011 g/m$^2$ Ninth Layer: Third Green-Sensitive Emulsion Layer A gelatin layer containing:
Silver iodobromide emulsion (spherical grains, iodide content: 8 mol%, average particle size: 1.8 μm), silver coated amount: 1.8 g/m$^2$
Sensitizing Dye E: $3.0\times10^{-4}$ mol per mol of silver
Sensitizing Dye G: $1.2\times10^{-4}$ mol per mol of silver
Coupler C-3: 0.008 g/m$^2$
Coupler C-12: 0.05 g/m$^2$
Coupler C-18: 0.001 g/m$^2$ Tenth Layer: Yellow Filter Layer A gelatin layer containing:
Yellow colloidal silver: 0.04 g/m$^2$
2,5-Di-tert-pentadecylhydroquinone: 0.031 g/m$^2$ Eleventh Layer: First Blue-Sensitive Emulsion Layer A gelatin layer containing:
Silver iodobromide emulsion (iodide content: 5 mol%, average particle size: 0.4 μm), silver coated amount: 0.32 g/m$^2$
Sensitizing Dye F: $2.5\times10^{-4}$ mol per mol of silver
Coupler C-13: 0.68 g/m$^2$
Coupler C-14: 0.03 g/m$^2$
Coupler C-19: 0.015 g/m$^2$ Twelfth Layer: Second Blue-Sensitive Emulsion Layer A gelatin layer containing:
Silver iodobromide emulsion (iodide content: 10 mol%, average particle size: 1.0 μm), silver coated amount: 0.29 g/m$^2$
Sensitizing Dye F: $2.2\times10^{-4}$ mol per mol of silver
Coupler C-13: 0.22 g/m$^2$ Thirteenth Layer: Fine Grain Emulsion Layer A gelatin layer containing:
Silver iodobromide emulsion (iodide content: 2 mol%, average particle size: 0.15 μm), silver coated amount: 0.4 g/m$^2$ Fourteenth Layer: Third Blue-Sensitive Emulsion Layer A gelatin layer containing:

Silver iodobromide emulsion (iodide content: 14 mol%, average particle size: 2.3 μm), silver coated amount: 0.79 g/m$^2$ Sensitizing Dye F: $2.3\times10^{-4}$ mol per mol of silver Coupler C-13: 0.19 g/m$^2$ Coupler C-15: 0.001 g/m$^2$ Fifteenth Layer: First Protective Layer A gelatin layer containing:

Ultraviolet Ray Absorbing Agent C-1: 0.14 g/m$^2$

Ultraviolet Ray Absorbing Agent C-2: 0.22 g/m$^2$

Sixteenth Layer: Second Protective Layer

A gelatin layer containing:

Polymethyl methacrylate particles (average particle size: 1.5 μm): 0.05 g/m$^2$

Silver iodobromide emulsion (iodide content: 2 mol%, average particle size: 0.07 μm), silver coated amount: 0.3 g/m$^2$ Gelatin Hardener C-16 and a surface active agent were incorporated into each of the layers in addition to the above described components.

The compounds employed for the preparation of the sample are illustrated below.

C-1

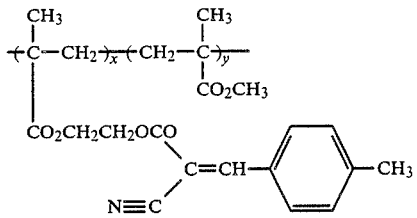

x:y = 7:3 (by weight)

C-2

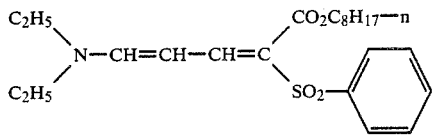

C-3

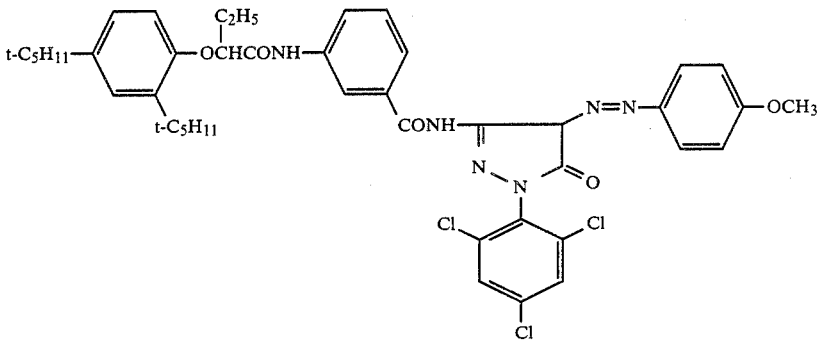

C-4

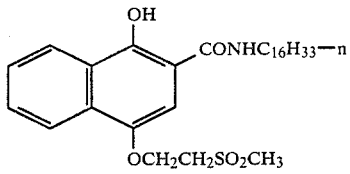

C-5

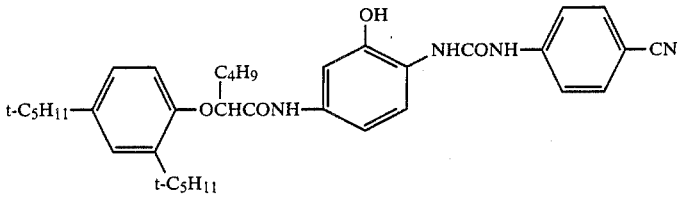

-continued
C-6
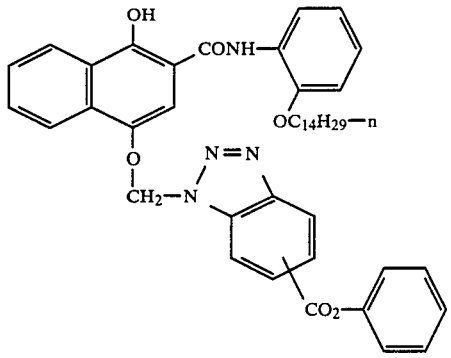
C-7
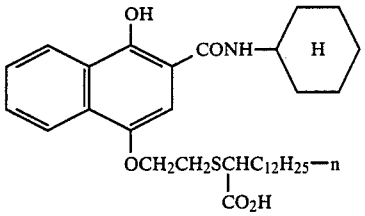
C-8
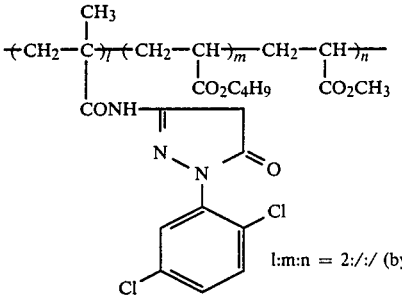
l:m:n = 2:/:/ (by weight)
C-10
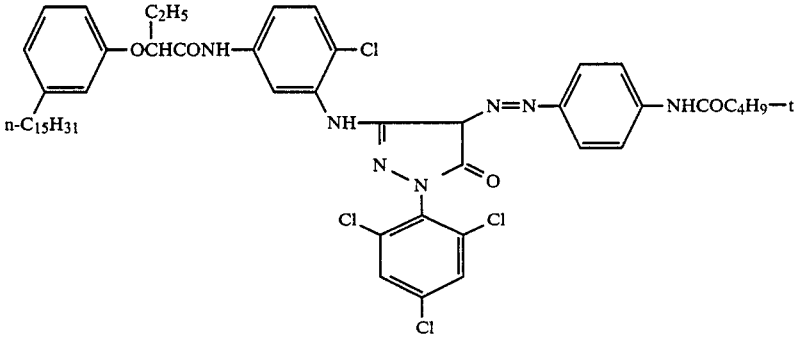
C-11
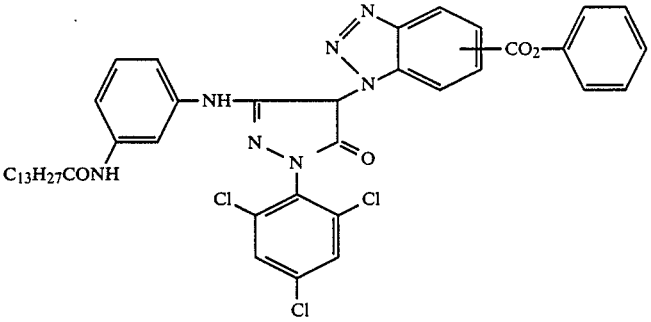

-continued
C-12
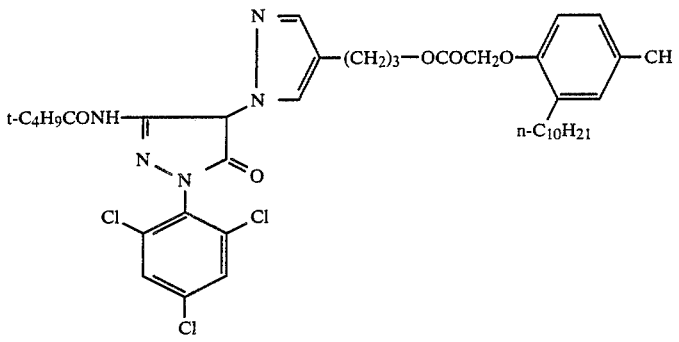
C-13
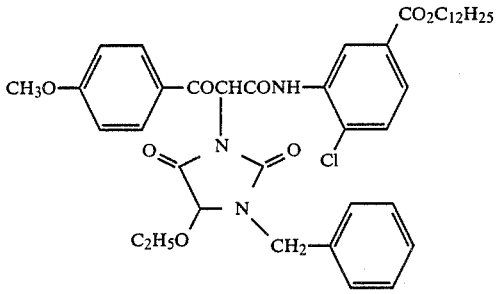
C-14
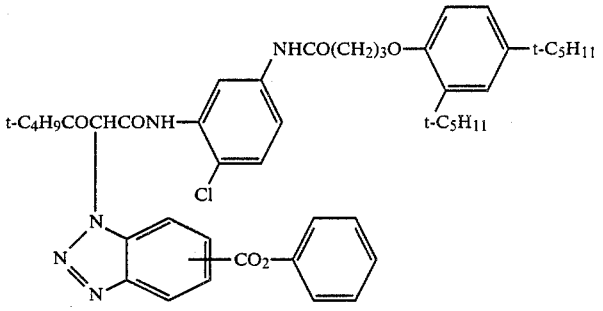
C-15
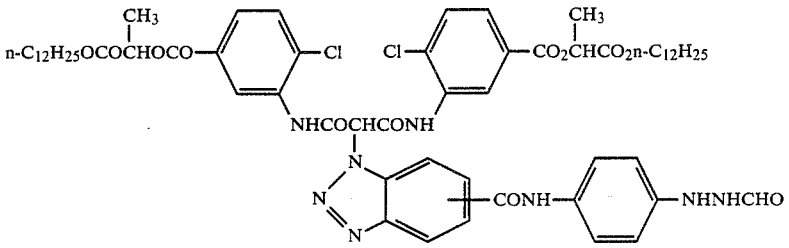
C-16
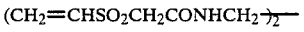
C-17
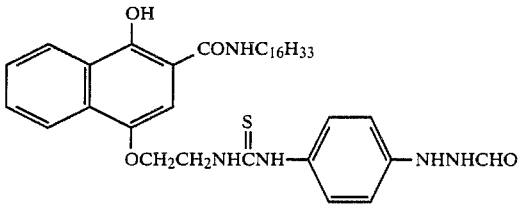

-continued
C-18
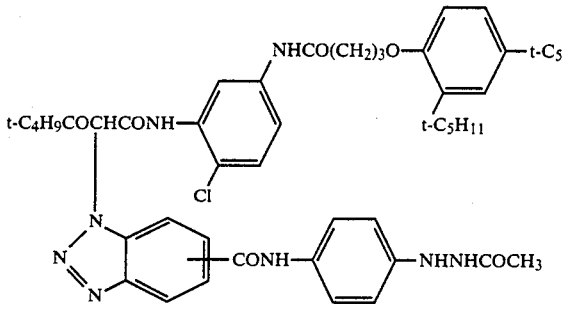
C-19
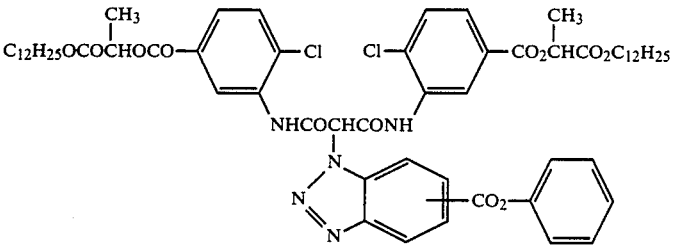
Sensitizing Dye A
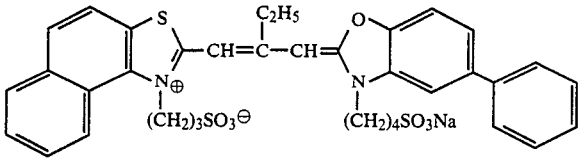
Sensitizing Dye B
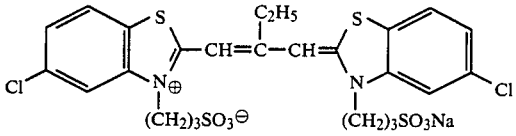
Sensitizing Dye C
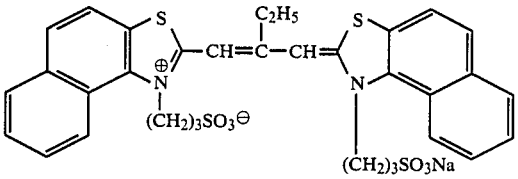
Sensitizing Dye D
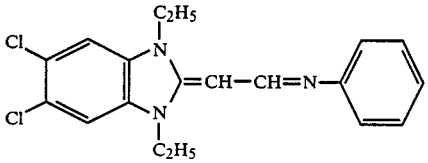
Sensitizing Dye E
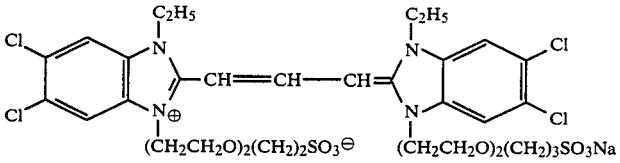
Sensitizing Dye F
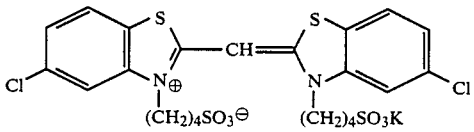

-continued

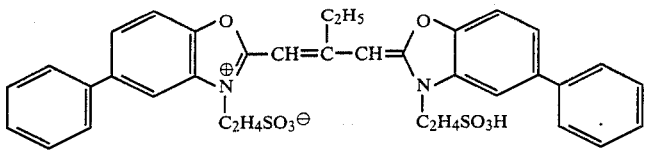

Sensitizing Dye G

Preparation of Sample 202

Sample 202 was prepared in the same manner as described for Sample 201 except using Emulsion D in place of Emulsion C in the ninth layer and the twelfth layer of Sample 201.

Preparation of Samples 203 and 204

Samples 203 and 204 were prepared in the same manner as described for Sample 201 except using Emulsions A and B, respectively, in place of Emulsion C in the ninth layer and the twelfth layer of Sample 201.

Preparation of Samples 205 and 207

Samples 205 and 207 were prepared in the same manner as described for Sample 201 except adding the compound shown in Table 3 below to the layers shown in Table 3 below in the amount shown in Table 3 below.

Preparation of Samples 208 to 211

Samples 208 to 211 were prepared in the same manner as described for Sample 202 except adding the compound shown in Table 3 below to the layers shown in Table 3 below in the amount shown in Table 3 below.

Preparation of Samples 212, 213 and 215 to 222

Samples 212, 213 and 215 to 222 were prepared in the same manner as described for Sample 203 except adding the compound shown in Table 3 below to the layers shown in Table 3 below in the amount shown in Table 3 below.

Preparation of Samples 214, 223 and 224

Samples 214, 223 and 224 were prepared in the same manner as described for Sample 204 except adding the compound shown in Table 3 below to the layers shown in Table 3 below in the amount shown in Table 3 below.

Each sample was divided into two parts, one part of each of Samples 201 to 224 was subjected to green light wedge exposure and the other part was subjected to white light wedge exposure (red light, green light and blue light). The green light exposure amount during the white light exposure was same as the exposure amount for the green light exposure per se. The samples exposed were then subjected to color development processing at 38° C. according to the following processing steps.

| Processing Steps | Time |
|---|---|
| 1. Color development | 3 min and 15 sec |
| 2. Bleaching | 6 min and 30 sec |
| 3. Washing with water | 3 min and 15 sec |
| 4. Fixing | 6 min and 30 sec |
| 5. Washing with water | 3 min and 15 sec |
| 6. Stabilizing | 3 min and 15 sec |

The composition of each processing solution used was as follows.

Color Developing Solution

Sodium nitrilotriacetate: 1.0 g
Sodium sulfite: 4.0 g
Sodium carbonate: 30.0 g
Potassium bromide: 1.4 g
Hydroxylamine sulfate: 2.4 g
4-(N-Ethyl-N-β-hydroxyethylamino)-2-methylaniline sulfate: 4.5 g
Water to make: 1.0 liter Bleaching Solution Ammonium bromide: 160.0 g
Aqueous ammonia (28 wt%): 25.0 ml
Sodium ethylenediaminetetraacetato iron (III): 130.0 g
Glacial acetic acid: 14.0 ml
Water to make: 1.0 liter Fixing Solution Sodium tetrapolyphosphate: 2.0 g
Sodium sulfite: 4.0 g
Ammonium thiosulfate aqueous solution (70 wt%): 175.0 ml
Sodium bisulfite: 4.6 g
Water to make: 1.0 liter Stabilizing Solution Formalin: 8.0 ml
Water to make: 1.0 liter The difference of exposure amounts between magenta at the green light exposure and magenta at the white light exposure was compared for each of the samples. It is considered that a greater interimage effect is obtained as with a larger value of the exposure amount difference (Δlog E) at a density of 0.6. Further, the MTF values were measured in order to determine the sharpness of these samples. The results thus obtained are shown in Table 3 below.

TABLE 3

| Sample No. | Emulsion in Ninth and Twelfth Layer | Compound Added | Layer Added to | Amount Added per Layer (mol/m²) | Sharpness: Magenta Image 5 cycles/mm | Sharpness: Magenta Image 30 cycles/mm | Sharpness: Cyan Image 5 cycles/mm | Sharpness: Cyan Image 30 cycles/mm | Δ log E* |
|---|---|---|---|---|---|---|---|---|---|
| 201 (Comparison) | Emulsion C | — | — | — | 0.83 | 0.60 | 0.72 | 0.49 | 0.15 |

TABLE 3-continued

| Sample No. | Emulsion in Ninth and Twelfth Layer | Compound Added | Layer Added to | Amount Added per Layer (mol/m²) | Sharpness Magenta Image 5 cycles/mm | Sharpness Magenta Image 30 cycles/mm | Sharpness Cyan Image 5 cycles/mm | Sharpness Cyan Image 30 cycles/mm | Δ log E* |
|---|---|---|---|---|---|---|---|---|---|
| 202 (Comparison) | Emulsion D | — | — | — | 0.81 | 0.64 | 0.70 | 0.51 | 0.16 |
| 203 (Comparison) | Emulsion A | — | — | — | 0.80 | 0.71 | 0.69 | 0.57 | 0.16 |
| 204 (Comparison) | Emulsion B | — | — | — | 0.78 | 0.71 | 0.68 | 0.57 | 0.16 |
| 205 (Comparison) | Emulsion C | Compound D | 3rd, 7th, 9th Layers | $2 \times 10^{-6}$ | 0.84 | 0.60 | 0.73 | 0.49 | 0.16 |
| 206 (Comparison) | " | (9)** | " | " | 0.92 | 0.61 | 0.81 | 0.49 | 0.30 |
| 207 (Comparison) | " | (47) D | " | " | 0.91 | 0.60 | 0.80 | 0.49 | 0.29 |
| 208 (Comparison) | Emulsion D | Compound D | " | " | 0.82 | 0.64 | 0.71 | 0.51 | 0.17 |
| 209 (Comparison) | " | Compound E | " | " | 0.81 | 0.64 | 0.71 | 0.51 | 0.17 |
| 210 (Comparison) | " | (9) | " | " | 0.91 | 0.64 | 0.80 | 0.51 | 0.30 |
| 211 (Comparison) | " | (47) | " | " | 0.90 | 0.64 | 0.79 | 0.51 | 0.29 |
| 212 (Comparison) | Emulsion A | Compound D | " | " | 0.81 | 0.71 | 0.69 | 0.57 | 0.17 |
| 213 (Comparison) | " | Compound E | " | " | 0.80 | 0.71 | 0.69 | 0.57 | 0.17 |
| 214 (Comparison) | Emulsion B | Compound D | " | " | 0.78 | 0.71 | 0.69 | 0.57 | 0.17 |
| 215 | Emulsion A | (9) | " | " | 0.92 | 0.73 | 0.81 | 0.59 | 0.32 |
| 216 | " | (47) | " | " | 0.91 | 0.72 | 0.80 | 0.58 | 0.31 |
| 217 | " | (21) | " | " | 0.91 | 0.72 | 0.80 | 0.58 | 0.31 |
| 218 | " | (35) | " | " | 0.91 | 0.72 | 0.80 | 0.58 | 0.31 |
| 219 | " | (41) | " | " | 0.91 | 0.72 | 0.79 | 0.58 | 0.30 |
| 220 | " | (49) | " | " | 0.91 | 0.72 | 0.80 | 0.58 | 0.31 |
| 221 | " | (9) | 2nd, 6th, 9th Layers | " | 0.90 | 0.72 | 0.79 | 0.57 | 0.30 |
| 222 | Emulsion A | (47) | " | " | 0.89 | 0.71 | 0.78 | 0.56 | 0.30 |
| 223 | Emulsion B | (9) | 3rd, 7th, 9th Layers | " | 0.90 | 0.73 | 0.78 | 0.58 | 0.30 |
| 225 | " | (47) | " | " | 0.89 | 0.72 | 0.78 | 0.57 | 0.30 |

*Δ log E at the magenta density of 0.6.
**All as earlier identified in the Specification.

Compound D:

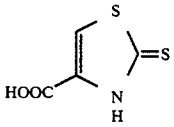

(compound described in Japanese Patent Publication No. 12677/71)

Compound E:

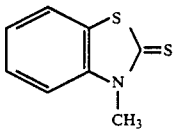

(compound described in Japanese Patent Publication No. 34169/73)

Compound D and Compound E were the same as those described in Example 1.

From the results shown in Table 3 above it can be understood that both sharpness at 5 cycles/mm and sharpness at 30 cycles/mm are effectively improved by the combination of the specified tabular silver halide grains and the specific compound according to the present invention. More specifically, the decrease in the MTF value at 5 cycles/mm due to the tabular grains as compared with spherical grains (Sample 201) is prevented by using a compound represented by the green formulae (I), (II), (III) and (IV). Further, the present invention provides almost the same sharpness at 5 cycles/mm and extremely good sharpness at 30 cycles/mm in comparison with the cases wherein the compound represented by the general formulae (I), (II), (III) and (IV) was used in combination with spherical grains (Samples 206 and 207).

EXAMPLE 3

Preparation of Sample 301

On a triacetate film support were coated the layers having the compositions shown below to prepare a black-and-white photographic light-sensitive material which was designated Sample 301.

First Layer: Emulsion Layer

Silver iodobromide emulsion (iodide content: 5 mol%, average particle size: 0.4 μm), silver coated amount: 1.5 g/m²

Second Layer: Emulsion Layer

Silver Iodobromide Emulsion C, silver coated amount: 1.5 g/m$^2$

Third Layer: Protective Layer

Gelatin: 1.3 g/m$^2$
Polymethyl methacrylate particles (average particle size: 1.5 μm): 0.05 g/m$^2$ Gelatin Hardener H-3, a surface active agent and a viscosity imparting agent (sodium polystyrenesulfonate) were incorporated into each of the layers in addition to the above described components.

Preparation of Samples 302 to 304

Samples 302 to 304 were prepared in the same manner as described for Sample 301 except using Emulsions D, A and B in place of Emulsion C in the second layer of Sample 301, respectively.

Preparation of Samples 305 and 306

Samples 305 and 306 were prepared in the same manner as described for Sample 301 except adding the compound shown in Table 4 below to the layers shown in Table 4 below in the amount shown in Table 4 below.

Preparation of Samples 307 to 310

Samples 307 to 310 were prepared in the same manner as described for Sample 302 except adding the compound shown in Table 4 below to the layers shown in Table 4 below in the amount shown in Table 4 below.

Preparation of Samples 311, 312 and 314 to 319

Samples 311, 312 and 314 to 319 were prepared in the same manner as described for Sample 303 except adding the compound shown in Table 4 below to the layers shown in Table 4 below in the amount shown in Table 4 below.

Preparation of Samples 313, 320 and 321

Samples 313, 320 and 321 were prepared in the same manner as described for Sample 304 except adding the compound shown in Table 4 below to the layers shown in Table 4 below in the amount shown in Table 4 below.

Samples 301 to 321 thus prepared were exposed to light through a pattern for measurement of graininess or a pattern for measurement of MTF and then subjected to development processing using the following processing solutions.

Developing Solution

Metal: 2 g
Sodium sulfite: 100 g
Hydroquinone: 5 g
Borax (pentahydrate): 1.53 g
Water to make: 1 liter Fixing Solution Ammonium thiosulfate: 200 g
Sodium sulfite (anhydrous): 20 g
Boric acid: 8 g
Disodium ethylenediaminetetraacetate: 0.1 g
Aluminium sulfate: 15 g
Sulfuric acid: 2 g
Glacial acetic acid: 22 g
Water to make: 1 liter
adjusted pH to 4.2

The black-and-white development was carried out at 20° C. for 7 minutes using the above described developing solution.

The graininess and sharpness of each sample were evaluated. More specifically, graininess (RMS granularity) was presented as a value which was 1,000 times the standard deviation of the density variation caused in case of scanning by a microdensitometer. Further, sharpness was determined using MTF values. The results thus obtained are shown in Table 4 below.

TABLE 4

| Sample No. | Emulsion in Second Layer | Compound Added | Layer Added to | Amount Added per Layer (mol/m$^2$) | Sharpness 5 cycles/mm | Sharpness 30 cycles/mm | Graininess D = 1.5 |
|---|---|---|---|---|---|---|---|
| 301 (Comparison) | Emulsion C | — | — | — | 0.86 | 0.62 | 28 |
| 302 (Comparison) | Emulsion D | — | — | — | 0.85 | 0.64 | 28 |
| 303 (Comparison) | Emulsion A | — | — | — | 0.83 | 0.72 | 28 |
| 304 (Comparison) | Emulsion B | — | — | — | 0.83 | 0.72 | 28 |
| 305 (Comparison) | Emulsion C | Compound D | 1st, 2nd Layers | $3 \times 10^{-6}$ | 0.87 | 0.62 | 28 |
| 306 (Comparison) | " | (3)* | " | " | 0.95 | 0.62 | 24 |
| 307 (Comparison) | Emulsion D | Compound D | " | " | 0.85 | 0.64 | 27 |
| 308 (Comparison) | " | Compound E | " | " | 0.86 | 0.64 | 28 |
| 309 (Comparison) | " | (3) | " | " | 0.93 | 0.64 | 24 |
| 310 (Comparison) | " | (53) | " | " | 0.93 | 0.64 | 24 |
| 311 (Comparison) | Emulsion A | Compound D | " | " | 0.84 | 0.72 | 28 |
| 312 (Comparison) | " | Compound E | " | " | 0.83 | 0.72 | 28 |
| 313 (Comparison) | Emulsion B | Compound D | " | " | 0.83 | 0.72 | 28 |

TABLE 4-continued

| Sample No. | Emulsion in Second Layer | Compound Added | Layer Added to | Amount Added per Layer (mol/m²) | Sharpness 5 cycles/mm | Sharpness 30 cycles/mm | Graininess D = 1.5 |
|---|---|---|---|---|---|---|---|
| 314 | Emulsion A | (3) | " | " | 0.95 | 0.74 | 23 |
| 315 | " | (53) | " | " | 0.94 | 0.73 | 24 |
| 316 | " | (6) | " | " | 0.93 | 0.73 | 24 |
| 317 | " | (17) | " | " | 0.93 | 0.73 | 24 |
| 318 | " | (37) | " | " | 0.93 | 0.73 | 24 |
| 319 | " | (41) | " | " | 0.93 | 0.72 | 24 |
| 320 | Emulsion B | (3) | " | " | 0.92 | 0.72 | 24 |
| 321 | " | (53) | " | " | 0.92 | 0.72 | 24 |

*All as earlier identified in the Specification.

Compound D

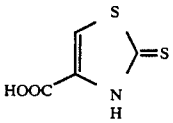

Compound E

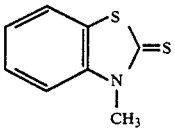

Compound D and Compound E were the same as those described in Example 1.

From the results shown in Table 4 shown it is apparent that the samples according to the present invention are excellent in both sharpness and graininess in comparison with the comparative samples.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer containing tabular silver halide grains which have a diameter not less than 5 times the thickness thereof and which account for at least 50% of the total projected area of the silver halide grains present in the silver halide emulsion layer, and wherein tabular silver halide grains having a ratio of diameter/thickness of 8 or more are present in an amount of not more than 50% of the total projected area, the silver halide photographic material also containing at least one compound represented by the following general formulae (I), (II), (III) and (IV):

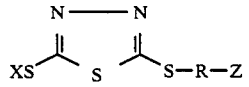

(I)

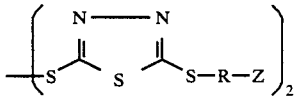

(II)

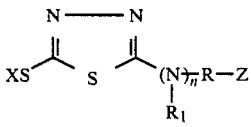

(III)

-continued

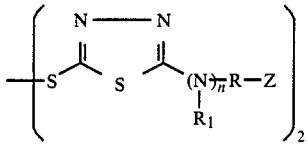

(IV)

wherein R represents a straight chain, branched chain or cyclic alkylene group, a straight chain or branched chain alkenylene group, a straight chain or branched chain aralkylene group or an arylene group; $R_1$ represents a substitute or unsubstituted alkyl group, a substituted or unsubstituted alkenyl group, a substituted or unsubstituted aralkyl group or a substituted or unsubstituted aryl group; Z represents a hydrogen atom or a polar substituent; X represents a hydrogen atom, a cation necessary for neutralizing the molecule or a precursor; and n represents 0 or 1.

2. A silver halide photographic material as claimed in claim 1, wherein the polar substituent represented by Z is a substituted or unsubstituted amino group or a salt thereof, a quaternary ammoniumyl group, an alkoxy group, an aryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a ureido group, an acyl group, an aryloxycarbonyl group, a thioureido group, a sulfonyloxy group, a heterocyclic group, a cyano group, a sulfonic acid group, a carboxylic acid group, a hydroxy group or an alkoxycarbonyl group.

3. A silver halide photographic material as claimed in claim 1, wherein the cation necessary for neutralizing the molecule represented by X is a sodium ion, a potassium ion, a zinc ion, a nickel ion, a magnesium ion, a calcium ion or an ammonium ion.

4. A silver halide photographic material as claimed in claim 1, wherein the precursor represented by X is a group capable of being converted to a hydrogen atom or an alkali metal ion under alkaline conditions.

5. A silver halide photographic material as claimed in claim 4, wherein the precursor represented by X is an acetyl group, a cyanoethyl group or a methanesulfonylethyl group.

6. A silver halide photographic material as claimed in claim 1, wherein the compound is represented by general formulae (I) and (III).

7. A silver halide photographic material as claimed in claim 6, wherein R represents a straight chain or branched chain alkylene group.

8. A silver halide photographic material as claimed in claim 6, wherein Z represents a substituted or unsubstituted amino group or a salt thereof.

9. A silver halide photographic material as claimed in claim 1, wherein the compound is incorporated into a light-sensitive silver halide emulsion layer.

10. A silver halide photographic material as claimed in claim 9, wherein the light-sensitive silver halide emulsion layer contains the tabular silver halide grains.

11. A silver halide photographic material as claimed in claim 9, wherein the amount of the compound is from $10^{-1}$ to $10^{-6}$ mol per mol of silver halide contained in the light-sensitive silver halide emulsion layer.

12. A silver halide photographic material as claimed in claim 1, wherein the compound is incorporated into a light-insensitive subsidiary layer.

13. A silver halide photographic material as claimed in claim 12, wherein the amount of the compound is from $10^{-8}$ to $10^{-2}$ mol/m$^2$ of the light-insensitive subsidiary layer.

14. A silver halide photographic material as claimed in claim 1, wherein the diameter of the tabular silver halide grains is from 0.4 to 5.0 $\mu$m.

15. A silver halide photographic material as claimed in claim 1, wherein the silver halide photographic material comprises at least one red-sensitive emulsion layer, at least one green-sensitive emulsion layer and at least one blue-sensitive emulsion layer.

16. A silver halide photographic material as claimed in claim 15, wherein the light-sensitive silver halide emulsion layer containing the tabular silver halide grains is the farthest light-sensitive silver halide emulsion layer from the support.

17. A silver halide photographic material as claimed in claim 1, wherein the tabular silver halide grains have a thickness of from 0.03 to 0.40 $\mu$m.

18. A silver halide photographic material as claimed in claim 1, wherein the layer containing tabular silver halide grains has a thickness in the range of from 0.3 to 6.0 $\mu$m.

19. A silver halide photographic material as claimed in claim 1, wherein the coating amount of the tabular silver halide grains is in a range of from 0.1 to 6 g/m$^2$.

20. A silver halide photographic material as claimed in claim 16, wherein the farthest light-sensitive silver halide emulsion layer from the support is a blue-sensitive silver halide emulsion layer.

21. A silver halide photographic material as claimed in claim 16, wherein the total thickness of one or more layers remoter from the support than the farthest light-sensitive layer is in a range of from 0.3 to 6.0 $\mu$m.

* * * * *